US008592341B2

(12) United States Patent
Tsuchimura et al.

(10) Patent No.: US 8,592,341 B2
(45) Date of Patent: Nov. 26, 2013

(54) REVERSIBLE THERMOSENSITIVE RECORDING MEDIUM AND REVERSIBLE THERMOSENSITIVE RECORDING MEMBER

(75) Inventors: Yu Tsuchimura, Shizuoka (JP); Satoshi Arai, Shizuoka (JP); Jun Maruyama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 76 days.

(21) Appl. No.: 13/421,020

(22) Filed: Mar. 15, 2012

(65) Prior Publication Data

US 2012/0238446 A1 Sep. 20, 2012

(30) Foreign Application Priority Data

Mar. 18, 2011 (JP) ..... 2011-061429

(51) Int. Cl.
*B41M 5/44* (2006.01)

(52) U.S. Cl.
USPC ..... 503/201; 503/204; 503/207; 503/226

(58) Field of Classification Search
USPC ..... 503/200–226
See application file for complete search history.

(56) References Cited

U.S. PATENT DOCUMENTS

| | | | | |
|---|---|---|---|---|
| 4,999,334 | A * | 3/1991 | Mehta et al. | 503/226 |
| 5,567,668 | A * | 10/1996 | Oda et al. | 503/204 |
| 7,659,916 | B2 | 2/2010 | Sakurai et al. | |
| 7,728,860 | B2 | 6/2010 | Kawahara et al. | |
| 7,732,373 | B2 | 6/2010 | Tatewaki et al. | |
| 7,760,218 | B2 | 7/2010 | Arai et al. | |
| 7,944,461 | B2 | 5/2011 | Sakurai et al. | |
| 8,088,712 | B2 | 1/2012 | Shimbo et al. | |
| 2009/0029854 | A1 | 1/2009 | Maruyama et al. | |
| 2009/0239747 | A1 | 9/2009 | Morita et al. | |
| 2010/0061198 | A1 | 3/2010 | Kawahara et al. | |
| 2011/0130280 | A1 | 6/2011 | Tsuchimura et al. | |

FOREIGN PATENT DOCUMENTS

| | | |
|---|---|---|
| JP | 3690638 | 6/2005 |
| JP | 2007-331382 | 12/2007 |
| JP | 11-334220 | 12/2009 |

* cited by examiner

*Primary Examiner* — Bruce H Hess
(74) *Attorney, Agent, or Firm* — Cooper & Dunham LLP

(57) ABSTRACT

A reversible thermosensitive recording medium including: a support; a reversible thermosensitive recording layer on the support; and a protective layer on the reversible thermosensitive recording layer, wherein the reversible thermosensitive recording layer contains an electron-donating color-forming compound and an electron-accepting compound, wherein the protective layer contains a polyester acrylate resin, and wherein the protective layer has a glass transition temperature of 230° C. or higher and has an elongation of 10% or higher.

11 Claims, 3 Drawing Sheets

REVERSIBLE THERMOSENSITIVE RECORDING MEDIUM AND REVERSIBLE THERMOSENSITIVE RECORDING MEMBER

BACKGROUND OF THE INVENTION

1. Field of the Invention

The present invention relates to a reversible thermosensitive recording medium and a reversible thermosensitive recording member having the reversible thermosensitive recording medium.

2. Description of the Related Art

Conventionally, the following thermosensitive recording medium has been widely known: the thermosentitive recording medium that uses a color reaction between an electron-donating color-forming compound (also referred to as "color former or leuco dye," hereinafter) and an electron-accepting compound (also referred to as "developer," hereinafter). As OA has advanced, the thermosensitive recording medium has become widely used as output paper of facsimile, word processors, and scientific measurement machines, and more recently as magnetic thermosensitive cards such as prepaid cards and point cards. As for such a thermosensitive recording medium in practical use, in terms of environmental concerns, an overhaul of how to recycle and reduce the amount used and other issues is urgently sought. However, because the coloring thereof is irreversible, it is not possible to delete a once-recorded image and repeatedly use. Moreover, among a few things that can be done is to add new information to a portion where no image is recorded; a recordable portion is limited in size. The fact is that the amount of information to be recorded is reduced, and that a new card is created after a recording area runs out. Against the backdrop of garbage and deforestation problems of recent years, it is hoped to develop a reversible thermosensitive recording medium that can be rewritten any number of times.

The problem with such a reversible thermosensitive recording medium is that, when an under layer is provided between a support and a reversible thermosensitive recording layer, a crack is more likely to occur. In view of this, there has been proposed a reversible thermosensitive recording medium having a protective layer (overcoat layer) made of highly flexible ultraviolet curing resin and having a tan δ peak temperature of 155° C. or lower (or a temperature at which dynamic relaxation occurs) (see Japanese Patent Application Laid-Open (JP-A) No. 11-334220). However, since the heat resistance is low, the durability decreases. Another problem is that residues adhere to a heat source such as a thermal head.

The applicant of the present application has previously proposed a reversible thermosensitive recording medium that includes a support, a thermosensitive recording layer on the support, and a protective layer on the thermosensitive recording layer, wherein the thermosensitive recording layer contains an electron-donating color-forming compound and an electron-accepting compound, the tone of color changes depending on temperatures in a reversible manner, and the protective layer contains a polymer of compositions including two types of acrylate compound, which are selected from among acrylate compounds having a pentaerythritol group and acrylate compounds having a dipentaerythritol group (see JP-A No. 2007-331382).

However, even the above proposal does not have performance sufficient enough in terms of all the following properties: durability, crack resistance, and resistance to formation of residue on the head (head-residue resistance). It is currently hoped to make further improvements and development.

SUMMARY OF THE INVENTION

An object of the present invention is to provide: a reversible thermosensitive recording medium that is excellent in crack resistance, heat resistance (especially, head-residue resistance) and durability (especially, free of degradation of color density even when coloring and decoloring are repeated); and a reversible thermosensitive recording member containing the reversible thermosensitive recording medium.

As a result of intensive studies by the present inventors with the aim of solving the above problems, it was found that, by allowing a protective layer on the outermost surface of a reversible thermosensitive recording medium to contain a polyester acrylate resin, to have a glass transition temperature of 230° C. or higher, and to have an elongation of 10% or higher, it is possible to improve flexibility, as well as durability, crack resistance and head-residue resistance. Furthermore, it is preferred that the protective layer contain spherical silicone particles. It was found that, because the mutual solubility of the spherical silicone particles with the polyester acrylate resin is low, the spherical silicone particles are not covered, and are exposed on the surface; and that the friction is therefore low, and it is possible to effectively prevent head residues from occurring.

The present invention is based on the finding obtained by present inventors. Means for solving the problems are as follows.

A reversible thermosensitive recording medium of the present invention includes:

a support;

a reversible thermosensitive recording layer on the support; and a protective layer on the reversible thermosensitive recording layer, wherein the reversible thermosensitive recording layer contains an electron-donating color-forming compound and an electron-accepting compound, wherein the protective layer contains a polyester acrylate resin, and wherein the protective layer has a glass transition temperature of 230° C. or higher and has an elongation of 10% or higher.

According to the present invention, it is possible to solve the above various problems associated with the conventional one, achieve the above object, and provide a reversible thermosensitive recording medium that is excellent in crack resistance, head-residue resistance and durability, and a reversible thermosensitive recording member containing the reversible thermosensitive recording medium.

Figure 1:
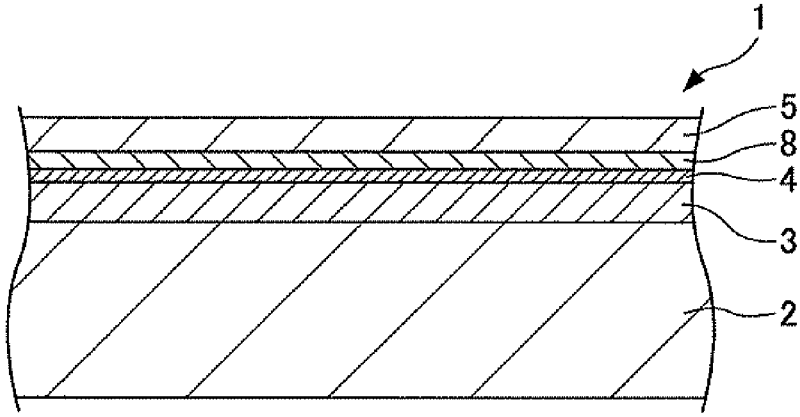
FIG. 1 is a schematic, partial cross-sectional view showing one example of a reversible thermosensitive recording medium according to the present invention.

DETAILED DESCRIPTION OF THE INVENTION (Reversible Thermosensitive Recording Medium)

A reversible thermosensitive recording medium of the present invention includes a support; a reversible thermosensitive recording layer, which is situated on the support; and a protective layer, which is situated on the reversible thermosensitive recording layer. The reversible thermosensitive recording medium also includes an under layer, a metallic compound-containing layer (gas barrier layer), a thermosetting resin-containing layer (primer layer), and an anchor layer. Furthermore, the reversible thermosensitive recording medium includes other layers when necessary.

<Protective Layer>

The protective layer is a layer provided on the outermost surface of the reversible thermosensitive recording medium and containing a polyester acrylate resin, and further containing particles and other components when necessary.

—Polyester Acrylate Resin—

The polyester acrylate resin is a polymer produced by ester linkage of acrylic acid to two or more alcohol residues of polyester, which is formed by dehydration synthesis of polybasic acid and polyhydric alcohol. The polyester acrylate resin represented by the following General Formula (I) is preferred.

General formula (I)

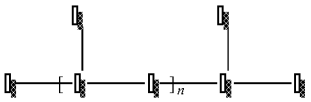

In General Formula (I), "A" represents a residue of acrylic acid; "X" represents a residue of polyhydric alcohol; "Y" represents a residue of polybasic acid; and "n" is the number of blocks repeated and is preferably an integer greater than or equal to 1.

The acrylic acid in the residue represented by "A" is, for example, acrylic acid, diacrylic acid, trimethylolpropane triacrylate, glycerin triacrylate, or pentaerythritol tetraacrylate.

As the polybasic acid in the residue represented by "Y", for example, the following can be listed: maleic acid, fumaric acid, mesaconine acid, citraconic acid, itaconic acid, glutaconic acid, phthalic acid, isophthalic acid, terephtalic acid, tetrachlorophthalic acid, cyclohexanedicarboxylic acid, succinic acid, adipic acid, sebacic acid, malonic acid, linoleic acid, trimellitic acid, and pyromellitic acid. One of the above components may be used independently; or alternatively, two or more of the above may be used together.

As the polyhydric alcohol in the residue represented by "X", for example, the following can be listed: ethylene glycol, diethylene glycol, propylene glycol, dipropylene glycol, 1,3-butylene glycol, neopentylglycol, bisphenol oxyethyl ether, glycerin, trimethylolpropane, and pentaerythritol. One of the above components may be used independently; or alternatively, two or more of the above may be used together.

As the polyester acrylate resin, appropriately synthesized resins or commercial products may be used. As for the commercial products, for example, the following can be listed: M9050, M8060, M8030, M7100, M8100, M8530 and M8560 (all manufactured by TOAGOSEI CO., LTD.). One of the above components may be used independently; or alternatively, two or more of the above may be used together.

The amount of the polyester acrylate resin in the protective layer is specifically restricted and can be appropriately selected according to the purpose, but is preferably 50% by mass to 95% by mass.

—Particles—

The shape of the particles is not specifically restricted, and can be appropriately selected according to the purpose. For example, the following shapes can be listed: a spherical shape, a granular shape, a tabular shape, an acicular shape and an amorphous shape. Among the above, a spherical shape is particularly preferred because its low friction coefficient is low to hardly generate head residues.

The spherical shape encompasses a truly spherical shape to substantially spherical shape resulting from slight deformation of the truly spherical shape.

The particles are not specifically restricted, and can be appropriately selected according to the purpose. For example, the following can be listed: inorganic particles, and organic particles. As for the above particles, only one type may be used independently; or alternatively, two or more types may be used together.

The inorganic particles are not specifically restricted, and can be appropriately selected according to the purpose. For example, the following can be listed: calcium carbonate, magnesium carbonate, silicic acid anhydride, hydrous silicate, hydrous aluminum silicate, hydrous calcium silicate, alumina, iron oxide, calcium oxide, magnesium oxide, chromium oxide, manganese oxide, silica, talc and mica.

The organic particles are not specifically restricted, and can be appropriately selected according to the purpose. For example, the following can be listed: silicone resins, cellulosic resins, epoxy resins, nylon resins, phenol resins, polyurethane resins, urea resins, melamine resins, polyester resins, polycarbonate resins, styrene resins such as styrene, polystyrene, polystyrene-isoprene and styrene vinyl benzene; acrylic resins such as acrylic vinylidene chloride, acrylic urethane, and acrylic ethylene; polyethylene resins; formaldehyde resins such as benzoguanamine formaldehyde and melamine formaldehyde, polymethyl methacrylate resins, and vinyl chloride resins.

Among the above particles, silica particles and silicone particles are preferred. In terms of head-residue resistance, silicone particles are particularly preferred. The mutual solubility of the silicone particles with the polyester acrylate resin is not good. Therefore, the polyester acrylate resin does not cover the silicone particles. As a result, the silicone particles are exposed on the surface, thereby making it difficult for residues stemming from the resin to appear on a heat source such as a thermal head.

The amount of the particles contained in the protective layer is preferably 1 part by mass to 30 parts by mass relative to 100 parts by mass of the polyester acrylate resin.

Furthermore, to the protective layer, an ultraviolet absorber, or a lubricant can be added when necessary.

The ultraviolet absorber is not specifically restricted, and can be appropriately selected according to the purpose. For example, the following can be listed: a compound having a salicylate structure, a compound having a cyanoacrylate structure, a compound having a benzotriazole structure, and a compound having a benzophenone structure.

The lubricant is not specifically restricted, and can be selected appropriately according to the purpose. For example, the following can be listed: a synthetic wax type, a vegetable wax type, an animal wax type, a higher alcohol type, a higher fatty acid type, a higher fatty acid ester type, and an amide type.

The protective layer can be formed by applying a protective-layer coating liquid, which contains a specific type of polyester acrylate resin and particles as well as other components when necessary, and drying.

As the method of applying the protective-layer coating liquid, for example, the following can be listed: a wire bar coating method, an air knife coating method, a blade coating method, a rod blade coating method, an air knife application method, a gravure application method, a roll coating application method, a spray application method, a dip application method and an extrusion application method.

The thickness of the protective layer is not specifically restricted, and can be selected appropriately according to the purpose. However, the thickness of the protective layer is preferably 0.1 μm to 20 μm, more preferably 0.3 μm to 10 μm.

The glass transition temperature of the protective layer is greater than or equal to 230° C., or preferably greater than or equal to 250° C. If the glass transition temperature is less than 230° C., the durability deteriorates as the heat resistance decreases. The head-residue resistance could decrease as well.

In this case, the glass transition temperature can be measured by a rigid body pendulum tester, for example.

The elongation of the protective layer is preferably greater than or equal to 10%, more preferably greater than or equal to 15%. If the elongation is less than 10%, the crack resistance could decrease.

In this case, the elongation can be calculated from the following equation by using, for example, a sample in which a protective layer is formed on a PET film, and a tensile strength tester:

$$\text{Elongation}(\%)=[(\text{length at the time of crack}-\text{original length})/\text{original length}]\times 100$$

The frictional resistance value of the protective layer is preferably less than or equal to 1.3, more preferably less than or equal to 1.0. If the frictional resistance value is over 1.3, the head-residue resistance could decrease.

In this case, the frictional resistance value can be measured by using a sample in which a protective layer is formed on a PET film, and a friction and wear analysis device, for example.

<Under Layer>

The under layer applies heat to the reversible thermosensitive recording layer; prevents heat from being transferred to the support side at a time when the electron-donating color-forming compound (color former) and the electron-accepting compound (developer) are melted; increases the heating efficiency of the reversible thermosensitive recording layer; and can avoid an adverse effect of the temperature rise of the support on materials.

The under layer contains at least hollow particles, and a binder resin, and furthermore contains other components when necessary.

The maximum particle diameter (D100) of the hollow particles is preferably 5 μm to 10 μm, more preferably 6 μm to 9 μm. If the maximum particle diameter (D100) is over 10 μm, the surface roughness could increase, and pinholes could appear when a solid image is printed. If the maximum particle diameter (D100) is less than 5 μm, it becomes difficult to ensure that the hollow particles have a hollow rate of 70% or more, resulting in lower heat sensitivity. When consideration is given only to increasing color optical density, then it is possible to bring about advantageous effects if the hollow rate is 60% or more. However, the reversible thermosensitive recording medium has an erasing process. In particular, according to an erasing method that uses a thermal head, the energy supplied for erasing is extremely smaller than a heat roller method. Therefore, it is necessary to further increase the degree to which the applied energy is effectively used. Accordingly, in order to ensure an erasing optical density with the erasing method that uses a thermal head and an expanded erasing energy region, the hollow rate of the hollow particles used in the under layer is preferably greater than or equal to 70%, more preferably greater than or equal to 80%.

The ratio (D100/D50) of the maximum particle diameter (D100) to the 50%-frequency particle diameter (D50) of the hollow particles is preferably 2 to 3, more preferably 2.2 to 2.9. The ratio (D100/D50) exceeding 3 means that the particle size distribution is in a broad state. In this case, the proportion of fine particles whose particle diameter is less than or equal to 1 μm becomes higher; in the under layer that uses the above particles, the distribution of the hollow particles becomes uneven, possibly leading to a decrease in sensitivity. If the ratio (D100/D50) is less than 2, the particle size distribution becomes extremely sharp. It is difficult to realize in terms of conditions for the synthesis of the hollow particles.

In this case, as for the hollow rate of the hollow particles, the particle diameter of the hollow particles is measured, and then the hollow rate is calculated. For example, the hollow particles are embedded in epoxy resin, which is then cut with a microtome. Then, a cut plane is observed under a scanning electron microscope (SEM), the outer diameter and inner diameter of the hollow particles are measured, and the hollow rate is calculated from the following equation 1:

$$\text{Hollow rate}(\%)=(\text{inner diameter of hollow particles})/(\text{outer diameter of hollow particles})\times 100$$

The particle diameter and particle size distribution of the hollow particles can be measured by, for example, a laser diffraction-type particle size distribution measuring device (manufactured by HORIBA, Ltd., LA-900). The median diameter (D50) is a particle diameter with a frequency of 50%. The maximum particle diameter (D100) is a maximum value of the distribution.

The hollow particles are preferably made of a vinyl polymer that includes a crosslinked structure as a shell material. The vinyl polymer having a crosslinked structure includes at least one type of vinyl monomer and at least one type of crosslinking monomer.

The vinyl monomer is not specifically restricted, and can be selected appropriately according to the purpose. For example, the following can be listed: a monomer having carboxylic acid within a molecule, such as acrylic acid ester, ethylene, propylene, vinyl acetate, styrene, acrylonitrile, methacrylonitrile, acrylic acid, methacrylic acid, succinic acid, and itaconic acid; metal carboxylate such as magnesium acrylate, calcium acrylate, zinc acrylate, magnesium methacrylate, calcium methacrylate, and zinc methacrylate; N-methylolacrylamide, N-methylolmetacrylamide, glycidyl acrylate, glycidyl methacrylate, 2-hydroxyethyl(meth)acrylate, 2-hydroxypropyl(meth)acrylate, 2-hydroxybutyl(meth)acrylate, 2-hydroxy-3-phenoxypropylacrylate, N,N-dimethylaminoethyl(meth)acrylate, N,N-dimethylaminopropyl methacrylate, magnesium monoacrylate and zinc monoacrylate, which have, within a molecule, a group reactive to carboxylic acid; acrylamide, methacrylamide, N,N-dimethylacrylamide, N,N-dimethylmethacrylamide, methyl methacrylate, t-butyl methacrylate, isobornyl(meth)acrylate, cyclohexyl methacrylate, benzyl methacrylate, N-vinylpyrrolidone, styrene, N-phenyl maleimide, N-naphthyl maleimide, N-cyclohexyl maleimide, and methyl maleimide.

The crosslinking monomer is not specifically restricted, and can be selected appropriately according to the purpose. For example, the following can be listed: ethylene glycol di(meth)acrylate, propylene glycol di(meth)acrylate, diethylene glycol di(meth)acrylate, 1,4-butanediol di(meth)acrylate, 1,6-hexanediol di(meth)acrylate, trimethylol propanetri (meth)acrylate, glycerin di(meth)acrylate, triethylene glycol di(meth)acrylate, PEG#200 di(meth)acrylate, PEG#400 di(meth)acrylate, PEG#600 di(meth)acrylate, 1,3-butanediol di(meth)acrylate, neopentylglycol di(meth)acrylate, 1,10-decanediol di(meth)acrylate, pentaerythritol tri(meth)acrylate, pentaerythritol tetra(meth)acrylate, pentaerythritol hexa(meth)acrylate 3-acryloyloxy glycerin monoacrylate, dimethylol tricyclodecane di(meth)acrylate, triallyl formal tri(meth) acrylate, polyethylene glycol dimethacrylate, triethylene glycol diacrylate, neopentylglycol dimethacrylate, polypropylene glycol dimethacrylate, 2,2'-bis(4-acryloxy diethoxy phenyl)propane, trimethylol propane trimethacrylate, diallyl phthalate, and divinylbenzene.

Among the above, a copolymer having at least acrylonitrile or meta-acrylonitrile as a monomer unit is particularly preferred.

The production method of the hollow particles is not specifically restricted, and can be selected appropriately according to the purpose. For example, the following can be listed: a method of containing a volatile substance as a core material, creating capsulated polymer particles whose outer shell (shell) is made of a polymer, and heating and foaming the polymer; and other methods.

The glass transition temperature (Tg) of the hollow particles (shell) is preferably greater than or equal to 45° C., more preferably greater than or equal to 60° C., still more preferably greater than or equal to 90° C. If the glass transition temperature is less than 45° C., blocking could occur at a time when the coating and winding of the produced reversible thermosensitive recording medium take place, or the hollow particles could get crushed easily. As a result, the function thereof may not be fulfilled.

—Binder Resin—

The binder resin is not specifically restricted, and can be selected appropriately according to the purpose. For example, the following can be listed: urea resins, melamine resins, phenol resins, epoxy resins, vinyl acetate resins, vinyl acetate-acrylic copolymers, ethylene-vinyl acetate copolymers, acrylic resins, polyvinyl ether resins, vinyl chloride-vinyl acetate copolymers, polystyrene resins, polyester resins, polyurethane resins, polyamide resins, chlorinated polyolefin resins, polyvinyl butyral resins, acrylic acid ester copolymers, methacrylic acid ester copolymers, natural rubber, cyanoacrylate resins, and silicone resins.

For the binder resin, a hydrophobic resin, ultraviolet curing resin, or aqueous polymer can be used.

As for the hydrophobic resin, for example, the following can be listed: styrene-butadiene copolymers, latexes of styrene-butadiene-acrylic ester copolymer; and emulsions of vinyl acetate, vinyl acetate-acrylic acid copolymers, styrene-acrylic ester copolymers, and acrylic ester resins, polyurethane resins.

As for the ultraviolet curing resin, for example, the following can be listed: urethane acrylate water-soluble ultraviolet curing resins, epoxy acrylate water-soluble ultraviolet curing resins, alkoxy acrylate ultraviolet curing resins, polyurethane acrylate ultraviolet curing emulsion, acrylic monomer, urethane acrylic oligomer, ether urethane acrylate oligomers, ester urethane acrylate oligomers, and polyester acrylate oligomers.

As the aqueous polymer, there are a water-soluble polymer and a water-dispersible polymer. As for the water-soluble polymer, for example, the following can be listed: completely saponified polyvinyl alcohol, carboxyl-modified polyvinyl alcohol, partially saponified polyvinyl alcohol, sulfonic acid-modified polyvinyl alcohol, silyl-modified polyvinyl alcohol, acetoacetyl-modified polyvinyl alcohol, diacetone-modified polyvinyl alcohol, and various other kinds of modified polyvinyl alcohol; starch or derivatives thereof; methoxy cellulose, hydroxyethyl cellulose, carboxymethyl cellulose, methyl cellulose, ethyl cellulose, and other cellulose derivatives; sodium polyacrylate, polyvinyl pyrrolidone, acrylamide/acrylic ester copolymer, alkali salt of styrene/maleic anhydride, alkali salt of isobutylene/maleic anhydride copolymer, polyacrylamide, sodium alginate, gelatin and casein.

As for the water-dispersible polymer, for example, the following can be listed: styrene-butadiene copolymers, latexes of styrene-butadiene-acrylic ester copolymer, vinyl acetate-acrylic acid copolymers, styrene-acrylic ester copolymers, acrylic ester resins, and emulsions of polyurethane resin.

The amount of the binder resin contained is preferably 100 parts by mass to 300 parts by mass relative to 100 parts by mass of the hollow particles, more preferably 100 parts by mass to 200 parts by mass. If the amount of the binder resin contained is less than 100 parts by mass, voids of the hollow particles remain, possibly causing a decline in the color optical density. If the amount exceeds 300 parts by mass, the proportion of hollow particles in the under layer decreases, possibly leading to a decrease in the heat insulation of the under layer as well as a decline in the sensitivity.

It is preferred that, in order to improve head-matching performance, an alkali-thickening binding agent be added to the under layer. The alkali-thickening binding agent is a binding agent whose thickening takes place under alkaline conditions.

The alkali-thickening binding agent can be used independently. However, in order for binding-agent components to exist as dispersed particles in a stable manner, for example, carboxylated latex, which is a copolymer of unsaturated carboxylic acid is preferably used. As for the carboxylated latex, as the pH is raised, highly carboxylated polymers on the surfaces of the particles dissolve in water, and thickening therefore takes place. Thus, it is possible to further improve the thickening of the binding agent. Since the under-layer coating liquid is maintained under alkaline conditions, a pH adjuster is required. For the pH adjuster, for example, aqueous $NH_3$ is used.

The alkali-thickening binding agent is not specifically restricted, and can be appropriately selected according to the purpose. Emulsion latex, which is mainly made from a styrene-butadiene copolymer, can be preferably listed.

The alkali-thickening binding agent not only has the thickening properties, but also works to bind hollow particles firmly together. Therefore, compared with when the thickening agent is used, the performance of matching with a thermal head becomes remarkably improved.

The amount of the alkali-thickening binding agent contained is preferably 1 part by mass to 80 parts by mass relative to 100 parts by mass of the hollow particles, more preferably 5 parts by mass to 50 parts by mass.

As for the under layer, along with the hollow particles and the binder resin, an auxiliary additive component, which is in common use for such a kind of thermosensitive recording medium, can be used when necessary; the auxiliary additive component may be, for example, a filler, heat-fusible component, or surfactant. In order for the under layer coating liquid to be applied evenly and at high speed, the viscosity of the 20% by mass aqueous dispersion liquid of the hollow particles is preferably less than or equal to 200 mPa·s at a solution temperature of 20° C. If the viscosity is over 200 mPa·s, the viscosity of the under-layer coating liquid increases, possibly resulting in uneven coating.

As the method of applying the under-layer coating liquid, for example, the following can be listed: a wire bar coating method, an air knife coating method, a blade coating method, a rod blade coating method, an air knife application method, a gravure application method, a roll coating application method, a spray application method, a dip application method, and an extrusion application method.

Incidentally, in order to further smoothen a surface of the under layer formed on the support, after the under layer is formed, a calendar process may be performed to smoothen the surface.

The thickness of the under layer is not specifically restricted, and can be selected appropriately according to the purpose. The thickness is preferably 3 μm to 50 μm, more preferably 5 μm to 30 μm.

<Reversible Thermosensitive Recording Layer>

The reversible thermosensitive recording layer (also referred simply as "thermosensitive recording layer," hereinafter) is not specifically restricted as long as the reversible thermosensitive recording layer is made of a reversible thermosensitive composition containing an electron-donating color-forming compound and an electron-accepting compound. The reversible thermosensitive recording layer can be selected appropriately according to the purpose.

The reversible thermosensitive recording layer is made of a composition containing a mixture of an electron-donating color-forming compound, whose coloring state changes according to a difference in the heating temperature and/or post-heating cooling rate, and an electron-accepting compound. The coloring and decoloring of the reversible thermosensitive recording medium are reversible, and take place depending on the temperature. The composition contains a resin that serves as a binder. The melting and solidification of the resin cause the coloring and decoloring of the color former to change, or cause the color former to freeze.

<<Electron-Donating Color-Forming Compound>>

The electron-donating color-forming compound (color former) is not specifically restricted, and can be appropriately selected according to the purpose. For example, the following can be listed: colorless or light-colored dye precursors (leuco dye), fluoran compounds, triphenylmethane phthalide compounds, azaphthalide compounds, phenothiazine compounds, leucauramine compounds and indolinophthalide compounds.

The fluoran compounds are not specifically restricted, and can be selected appropriately according to the purpose. For example, the following can be listed: 2-anilino-3-methyl-6-diethylaminofluoran, 2-anilino-3-methyl-6-di(n-butylamino)fluoran, 2-anilino-3-methyl-6-(N-n-propyl-N-methylamino)fluoran, 2-anilino-3-methyl-6-(N-isopropyl-N-methylamino)fluoran, 2-anilino-3-methyl-6-(N-isobutyl-N-methylamino)fluoran, 2-anilino-3-methyl-6-(N-n-amyl-N-methylamino)fluoran, 2-anilino-3-methyl-6-(N-sec-butyl-N-methylamino)fluoran, 2-anilino-3-methyl-6-(N-n-amyl-N-ethylamino)fluoran, 2-anilino-3-methyl-6-(N-iso-amyl-N-ethylamino)fluoran, 2-anilino-3-methyl-6-(N-n-propyl-N-isopropylamino)fluoran, 2-anilino-3-methyl-6-(N-cyclohexyl-N-methylamino)fluoran, 2-anilino-3-methyl-6-(N-ethyl-p-toluidino)fluoran, 2-anilino-3-methyl-6-(N-methyl-p-toluidino)fluoran, 2-(m-trichloromethylanilino)-3-methyl-6-diethylaminofluoran, 2-(m-(trifluoromethylanilino-3-methyl-6-diethylaminofluoran, 2-(m-trichloromethylanilino)-3-methyl-6-(N-cyclohexyl-N-methylamino)fluoran, 2-(2,4-dimethylanilino)-3-methyl-6-diethylaminofluoran, 2-(N-ethyl-p-toluidino)-3-methyl-6-(N-ethylanilino)fluoran, 2-(N-ethyl-p-toluidino)-3-methyl-6-(N-propyl-p-toluidino)fluoran, 2-aniline-6-(N-n-hexyl-N-ethylamino)fluoran, 2-(o-chloroanilino)-6-diethylaminofluoran, 2-(o-chloroanilino)-6-dibutylaminofluoran, 2-(m-trifluoromethylanilino)-6-diethylaminofluoran, 2,3-dimethyl-6-dimethylaminofluoran, 3-methyl-6-(N-ethyl-p-toluidino)fluoran, 2-chloro-6-diethylaminofluoran, 2-bromo-6-diethylaminofluoran, 2-chloro-6-dipropylaminofluoran, 3-chloro-6-cyclohexylaminofluoran, 3-bromo-6-cyclohexylaminofluoran, 2-chloro-6-(N-ethyl-N-isoamylamino)fluoran, 2-chloro-3-methyl-6-diethylaminofluoran, 2-anilino-3-chloro-6-diethylaminofluoran, 2-(o-chloroanilino)-3-chloro-6-cyclohexylaminofluoran, 2-(m-trifluoromethylanilino)-3-chloro-6-diethylaminofluoran, 2-(2,3-dichloroanilino)-3-chloro-6-diethylaminofluoran, 1,2-benzo-6-diethylaminofluoran, and 3-diethylamino-6-(m-trifluoromethylanilino)fluoran.

As for the azaphthalide compounds, for example, the following can be listed:

3-(1-ethyl-2-methylindole-3-yl)-3-(2-ethoxy-4-diethylaminophenyl)-4-azaphthalide, 3-(1-ethyl-2-methylindole-3-yl)-3-(2-ethoxy-4-diethylaminophenyl)-7-azaphthalide, 3-(1-octyl-2-methylindole-3-yl)-3-(2-ethoxy-4-diethylaminophenyl)-4-azaphthalide, 3-(1-ethyl-2-methylindole-3-yl)-3-(2-methyl-4-diethylaminophenyl)-4-azaphthalide, 3-(1-ethyl-2-methylindole-3-yl)-3-(2-methyl-4-diethylaminophenyl)-7-azaphthalide, 3-(1-ethyl-2-methylindole-3-yl)-3-(4-diethylaminophenyl)-4-azaphthalide, 3-(1-ethyl-2-methylindole-3-yl)-3-(4-N-n-amyl-N-methylaminophenyl)-4-azaphthalide, 3-(1-methyl-2-methylindole-3-yl)-3-(2-hexyloxy-4-diethylaminophenyl)-4-azaphthalide, 3,3-bis(2-ethoxy-4-diethylaminophenyl)-4-azaphthalide, and 3,3-bis(2-ethoxy-4-diethylaminophenyl)-7-azaphthalide.

As for the leuco dye, for example, the following can be listed: 2-(p-acetylanilino)-6-(N-n-amyl-N-n-butylamino)fluoran, 2-benzylamino-6-(N-ethyl-p-toluidino)fluoran, 2-benzylamino-6-(N-methyl-2,4-dimethylanilino)fluoran, 2-benzylamino-6-(N-ethyl-2,4-dimethylanilino)fluoran, 2-benzylamino-6-(N-methyl-p-toluidino)fluoran, 2-benzylamino-6-(N-ethyl-p-toluidino)fluoran, 2-(di-p-methylbenzylamino)-6-(N-ethyl-p-toluidino)fluoran, 2-(α-phenylethylamino)-6-(N-ethyl-p-toluidino)fluoran, 2-methylamino-6-(N-methylanilino)fluoran, 2-methylamino-6-(N-ethylanilino)fluoran, 2-methylamino-6-(N-propylanilino)fluoran, 2-ethylamino-6-(N-methyl-p-toluidino)fluoran, 2-methylamino-6-(N-methyl-2,4-dimethylanilino)fluoran, 2-ethylamino-6-(N-ethyl-2,4-dimethylanilino)fluoran, 2-dimethylamino-6-(N-methylanilino)fluoran, 2-dimethylamino-6-(N-ethylanilino)fluoran, 2-diethylamino-6-(N-methyl-p-toluidino)fluoran, 2-diethylamino-6-(N-ethyl-p-toluidino)fluoran, 2-dipropylamino-6-(N-methylanilino)fluoran, 2-dipropylamino-6-(N-ethylanilino)fluoran, 2-amino-6-(N-methylanilino)fluoran, 2-amino-6-(N-ethylanilino)fluoran, 2-amino-6-(N-propylanilino)fluoran, 2-amino-6-(N-methyl-p-toluidino)fluoran, 2-amino-6-(N-ethyl-p-toluidino)fluoran, 2-amino-6-(N-propyl-p-toluidino)fluoran, 2-amino-6-(N-methyl-p-ethylanilino)fluoran, 2-amino-6-(N-ethyl-p-ethylanilino)fluoran, 2-amino-6-(N-propyl-p-ethylanilino)fluoran, 2-amino-6-(N-methyl-2,4-dimethylanilino)fluoran, 2-amino-6-(N-ethyl-2,4-dimethylanilino)fluoran, 2-amino-6-(N-propyl-2,4-dimethylanilino)fluoran, 2-amino-6-(N-methyl-p-chloroanilino)fluoran, 2-amino-6-(N-ethyl-p-chloroanilino)fluoran, 2-amino-6-(N-propyl-p-chloroanilino)fluoran, 1,2-benzo-6-(N-ethyl-N-isoamylamino)fluoran, 1,2-benzo-6-dibutylaminofluoran, 1,2-benzo-6-(N-methyl-N-cyclohexylamino)fluoran, and 1,2-benzo-6-(N-ethyl-N-toluidino)fluoran. One of the above components may be used independently; or alternatively, two or more of the above components may be used together.

The mean particle diameter of the leuco dye is not specifically restricted, and can be selected appropriately according to the purpose. However, the mean particle diameter is preferably 0.05 μm to 0.7 μm, more preferably 0.1 μm to 0.5 μm, and particularly more preferably 0.1 μm to 0.3 μm. When the mean particle diameter of the leuco dye is 0.05 μm to 0.7 μm, the chromogenic property of the reversible thermosensitive recording layer becomes improved. To the leuco dye, a dispersing agent and/or a surfactant is added when necessary. In this case, it is possible to disperse while adjusting the mean particle diameter to 0.05 μm to 0.7 μm. 5% by mass to 20% by mass of the dispersing agent and/or the surfactant may be contained in the leuco dye in terms of mass standard. Incidentally, for a dispersing device, for example, the following can be used: a ball mill, an attritor, a sand mill, and a high-pressure jet mill. For micronization and dispersing, a method that uses media such as balls is preferred. Zirconia media with a diameter of 0.5 mm or less are used from the beginning; or alternatively, coarse crushing is carried out with the use of zirconia media that are greater than or equal to 0.5 mm and less than or equal to 1.0 mm in diameter. Then, zirconia media with a diameter of 0.5 mm or less are used to disperse, thereby making micronization possible.

In this case, the mean particle diameter of leuco dye can be measured by, for example, a laser analysis/scattering method (for example, Microtrac HRA 9320-X100-type; LA920-type, manufactured by HORIBA, Ltd.; the Lasentec FBRM device).

<<Electron-Accepting Compound>>

The electron-accepting compound (developer) is not specifically restricted as long as the electron-accepting compound causes the electron-donating color-forming compound (color former) to produce color. The electron-accepting compound can be selected appropriately according to the purpose. For example, the following can be listed: organophosphate compounds, aliphatic carboxylic acid compounds, phenolic compounds, metal salts of mercaptoacetic acid, and phosphate ester. The above may be selected in combination with the electron-donating color-forming compound (color former), with the melting points and color-developing performance taken into account.

The electron-accepting compound (developer) is not specifically restricted, and can be selected appropriately according to the purpose. However, in terms of the color optical density and erasing characteristics, the compound represented by the following General Formula (1) is preferred:

General Formula (1)

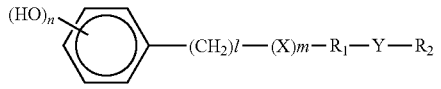

In General Formula (1), "l" represents an integer of ranging from 0 to 2; "m" represents an integer of 0 or 1; n represents an integer ranging from 1 to 3; and "X" and "Y" represent a divalent organic group containing an N- or O-atom.

"$R_1$" represents an aliphatic hydrocarbon group that contains two or more carbon atoms and can have a substituent. "$R_2$" represents an aliphatic hydrocarbon group that contains one or more carbon atoms.

In the General Formula (1), the aliphatic hydrocarbon group may be a straight chain, or have a branch. The aliphatic hydrocarbon group may have an unsaturated linkage. As for the substituent of the aliphatic hydrocarbon group, the following can be listed: a hydroxyl group, a halogen atom, and an alkoxy group. If the number of carbon atoms at $R_1$ and $R_2$ is less than or equal to seven in total, there could be a decrease in the stability of color development, as well as in the erasability. Therefore, the total number of carbon atoms at $R_1$ and $R_2$ is preferably greater than or equal to eight, more preferably greater than or equal to 11.

As for the aliphatic hydrocarbon group $R_1$, for example, the following can be listed:

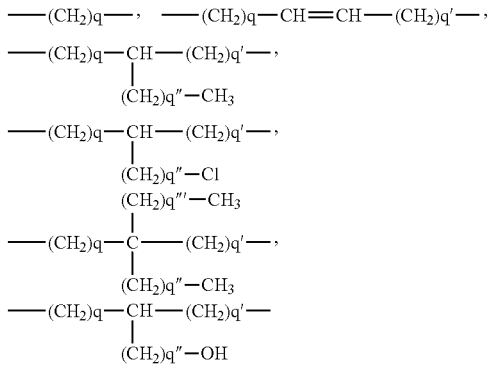

Incidentally, in the formulae, q, q', q" and q"' each represent an integer satisfying the number of carbon atoms at the $R_1$ and $R_2$ described above. Among the above, $—(CH_2)_q—$ is preferred.

As for the aliphatic hydrocarbon group $R_2$, for example, the following can be listed:

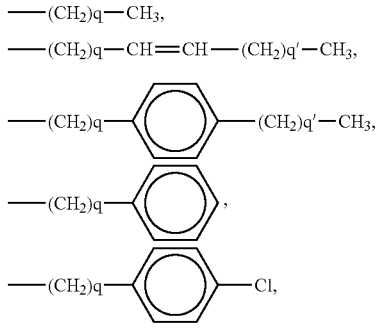

-continued

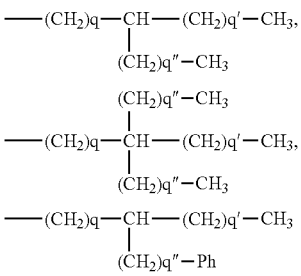

Incidentally, in the formulae, q, q', q" and q'" each represent the same as the above. Among the above, $—(CH_2)_q—CH_3$ is preferred.

"X" and "Y" represent a divalent group containing an N- or O-atom, and preferably a divalent group containing one or more of the following groups:

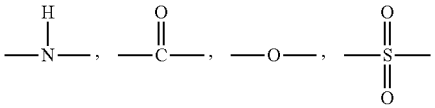

As for the examples thereof, the following can be listed.

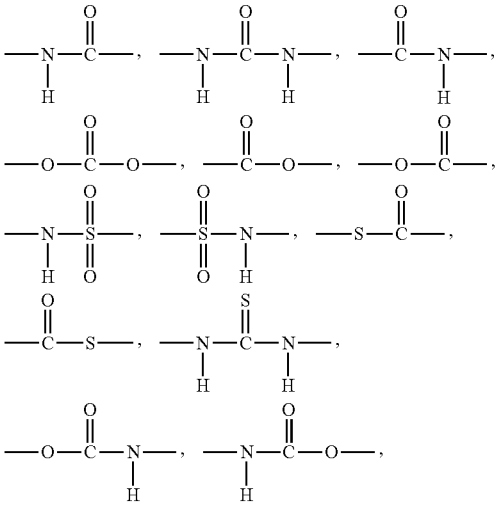

-continued

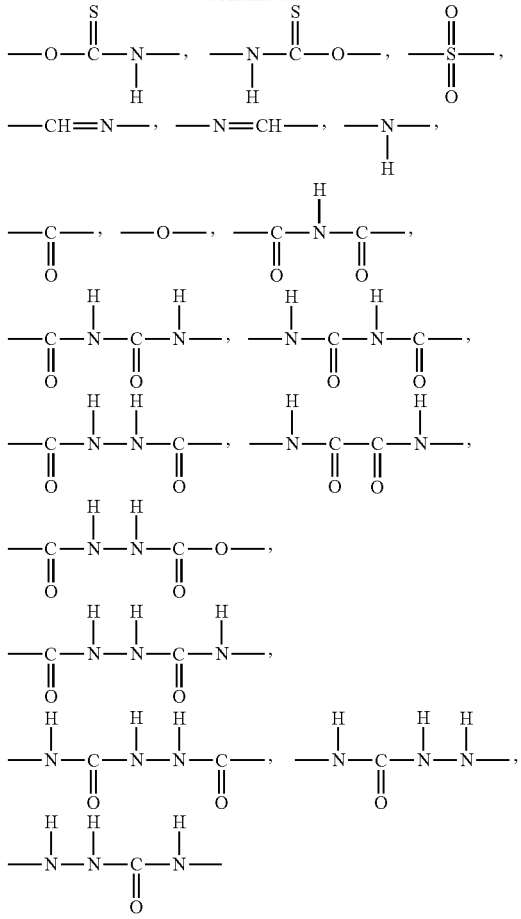

Among the above, the following are preferred.

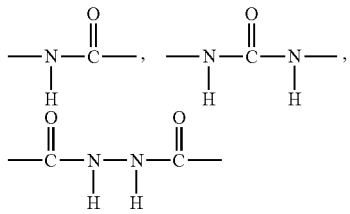

As for compounds represented by the above General Formula (1), for example, the following can be listed:

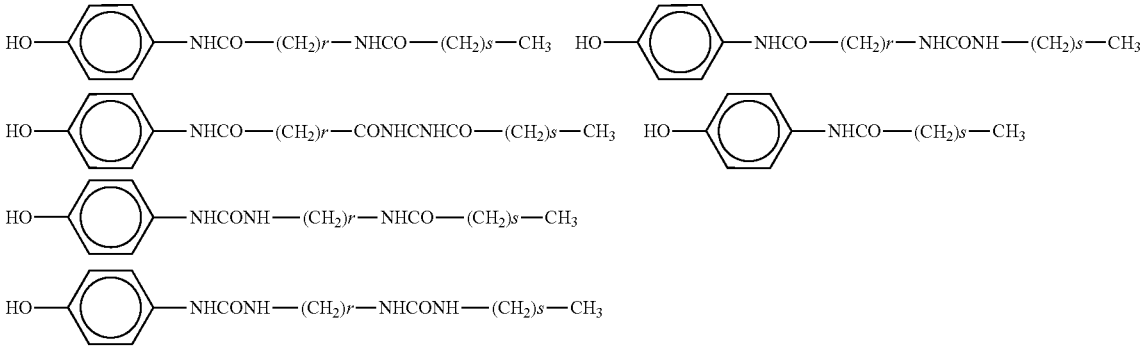

-continued

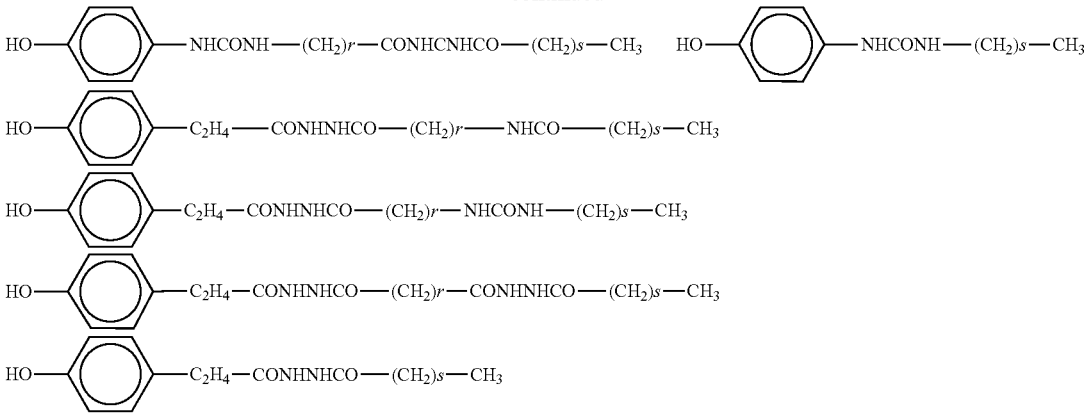

In the formulae, "r" represents an integer greater than or equal to 2; and "s" represents an integer greater than or equal to 1.

The mean particle diameter of the electron-accepting compound (developer) is not specifically restricted, and can be selected appropriately according to the purpose. The mean particle diameter is preferably 0.1 μm to 2.5 μm, more preferably 0.5 μm to 2.0 μm. If the mean particle diameter of the electron-accepting compound (developer) is 0.1 μm to 2.5 μm, it is possible to improve the chromogenic property at a time when the electron-accepting compound is used as the electron-accepting compound (developer) for the reversible thermosensitive recording medium. Furthermore, the mean particle diameter that is within the above-described more preferred range is favorable in terms of the above improvements in the chromogenic property.

The molar ratio of the electron-donating color-forming compound (color former) to the electron-accepting compound (developer) is not specifically restricted, and can be selected appropriately according to the purpose. However, the molar ratio is preferably 1:0.1 to 1:20, more preferably 1:0.2 to 1:10. Regardless of whether the electron-accepting compound (developer) is small or large in amount, the density of coloring state could decrease and cause a problem. The electron-donating color-forming compound (color former) and the electron-accepting compound (developer) may be stored in a microcapsule before being used.

The molar ratio of coloring components to resin in the reversible thermosensitive recording layer is preferably 1:0.1 to 1:10. If the resin is small in amount, the heat intensity of the reversible thermosensitive recording layer becomes insufficient. If the resin is large in amount, the color optical density decreases.

The electron-accepting compound (developer) can be dispersed, as the dispersing agent and/or surfactant are added along with the leuco dye and as the mean particle diameter is adjusted to the range 0.05 μm to 0.7 μm. The amount of the dispersing agent and/or surfactant contained in the leuco dye is greater than or equal to 5% by mass and less than or equal to 20% by mass in terms of mass standard.

As for a dispersing device used for the dispersing, for example, the following can be used: a ball mill, an attritor, a sand mill, and a high-pressure jet mill. For micronization and dispersing, a method that uses media such as balls is preferred. Zirconia media with a mean particle diameter of 0.5 mm or less are used; or alternatively, coarse crushing is carried out with the use of zirconia media that are greater than or equal to 0.5 mm and less than or equal to 1.0 mm in mean particle diameter. Then, zirconia media with a diameter of 0.5 mm or less are used to disperse, thereby making micronization possible.

In this case, the mean particle diameter of the electron-accepting compound (developer) can be measured by, for example, a laser analysis/scattering method (for example, Microtrac HRA 9320-X100-type; LA920-type, manufactured by HORIBA, Ltd.; the Lasentec FBRM device).

<<Reversible Thermosensitive Composition>>

The reversible thermosensitive composition is not specifically restricted as long as the reversible thermosensitive composition contains an electron-donating color-forming compound and an electron-accepting compound. The reversible thermosensitive composition can be selected appropriately according to the purpose. For example, the electron-donating color-forming compound and the electron-accepting compound are compositions that are dispersed in a binder resin; an additive agent can be used when necessary to improve, or control, the application properties of the thermosensitive recording layer and the coloring/decoloring properties. As for the additive agent, for example, the following can be listed: a control agent, a surfactant, a conducting agent, a filling agent, an antioxidant, a light stabilizer, and a color stabilizer.

—Binder Resin—

The binder resin has a function of maintaining a situation where materials of the reversible thermosensitive composition each remain evenly dispersed without becoming uneven even as heat is applied for recording and deleting.

The binder resin is not specifically restricted, and can be selected appropriately according to the purpose. For example, the following can be listed: polyvinyl chloride, polyvinyl acetate, vinyl chloride-vinyl acetate copolymers, ethylcellulose, polystyrene, styrene copolymers, phenoxy resins, polyester, aromatic polyester, polyurethane, polycarbonate, polyacrylic acid ester, polymethacrylic acid ester, acrylic acid copolymers, maleic acid copolymers, polyvinyl alcohol, modified polyvinyl alcohol, hydroxyethyl cellulose, carboxymethyl cellulose, and starches. Among the above, a high heat-resistance binder resin, which is for example a binder resin that is cross-linked by heat, ultraviolet rays, electron rays, or a crosslinking agent, is preferred.

The binder resin that has not yet been cross-linked is not specifically restricted, and can be selected appropriately according to the purpose. For example, the following can be listed: acrylic polyol resins, polyester polyol resins, polyurethane polyol resins, phenoxy resins, polyvinyl butyral resins, cellulose acetate propionate, a resin having a group reactive to a crosslinking agent such as cellulose acetate butyrate, a resin in which a monomer having a group reactive to a crosslinking agent and another monomer become copolymerized. Incidentally, the binder resin is not limited to a cross-linked resin that is obtained by combining the above resins that have not yet been cross-linked and a crosslinking agent.

The acrylic polyol resin is not specifically restricted, and can be selected appropriately according to the purpose. For example, the following can be listed: an acrylic polyol resin that uses, as a hydroxyl monomer, hydroxyethyl acrylate (HEA), hydroxypropyl acrylate (HPA), 2-hydroxyethyl methacrylate (HEMA), 2-hydroxypropyl methacrylate (HPMA), 2-hydroxybutyl monoacrylate (2-HBA), and 1-hydroxybutyl monoacrylate (1-HBA). Among the above hydroxyl monomers, in terms of the cracking resistance and durability of a coating film, 2-hydroxyethyl methacrylate, which includes a primary hydroxyl group, is preferred.

The crosslinking agent is not specifically restricted, and can be selected appropriately according to the purpose. For example, the following can be listed: isocyanates, amines, phenols, and epoxy compounds. Among the above, isocyanates (isocyanate compounds) are preferred.

The isocyanate compounds are not specifically restricted, and can be selected appropriately according to the purpose. The following can be listed: a well-known urethane-modified body of isocyanate monomer, allophanate-modified body, isocyanurate-modified body, burette-modified body, carbodiimide-modified body, a modified body such as blocked isocyanate. The isocyanate monomer that forms the modified body is not specifically restricted, and can be selected appropriately according to the purpose. For example, the following can be listed: tolylene diisocyanate (TDI), 4,4'-diphenyl methane diisocyanate (MDI), xylylene diisocyanate (XDI), naphthylene diisocyanate (NDI), paraphenylene diisocyanate (PPM, tetramethyl xylylene diisocyanate (TMXDI), hexamethylene diisocyanate (HDI), dicyclohexylmethane diisocyanate (HMDI), isophorone diisocyanate (IPDI), lysine diisocyanate (LDI), isopropylidene bis(4-cyclohexyl isocyanate) (IPC), cyclohexyl diisocyanate (CHDI) and tolidine diisocyanate (TODI).

To the reversible thermosensitive composition, a crosslinking promoter may be added. The crosslinking promoter is not specifically restricted, and can be selected appropriately according to the purpose. For example, the following can be listed: tertiary amines such as 1,4-diaza-bicyclo[2,2,2]octane, metallic compounds such as organotin compounds. The full dosage of the crosslinking agent added may exhibit a crosslinking reaction, or may not. That is, there may be some unreacted crosslinking agent. Such a kind of crosslinking reaction proceeds with time. The existence of unreacted crosslinking agent does not indicate that the crosslinking reaction does not proceed at all. The fact that the unreacted crosslinking agent has been detected does not necessarily mean that there is no resin in a crosslinked state. As for a method of making a determination as to whether the polymer is in a crosslinked state or in a non-crosslinked state, the determination can be made by immersing a coating film in a highly-soluble solvent. That is, a polymer in a non-crosslinked state dissolves in the solvent, and does not remain in the solute. Therefore, whether the polymer exists in the solute is analyzed. If the polymer is confirmed to exist in the solute, it can be said that the polymer is in a crosslinked state, and the polymer can be distinguished from a non-crosslinked polymer. In this case, the above can be expressed in gel fraction.

The gel fraction is a generation rate of the gel at a time when a resin solute gathers after losing independent motion in a solvent due to interaction and turns into a solidified state (gel). The gel fraction of the binder resin is not specifically restricted, and can be selected appropriately according to the purpose. For example, the gel fraction is preferably greater than or equal to 30%, more preferably greater than or equal to 50%, particularly more preferably greater than or equal to 70%, and particularly even more preferably greater than or equal to 80%. If the gel fraction is less than 30%, there can be a decrease in repeated durability. In order to increase the gel fraction, into the binder resin, a hardening resin, which is cured by heat, UV, or EB, is blended; or alternatively, the resin is cross-linked.

The method of measuring the gel fraction is not specifically restricted, and can be selected appropriately according to the purpose. For example, the following method and other methods can be listed: a film is separated from the support, and the initial mass of the film is measured; the film is then sandwiched by 400-mesh wire netting, immersed for 24 hours in a solvent that enables a resin that has not yet been crosslinked to dissolve therein, and then vacuum-dried; and the mass of the dried film is measured.

The gel fraction is calculated by the following equation:

$$\text{Gel fraction}(\%)=[\text{mass of dried film (g)}/\text{initial mass (g)}]\times 100$$

When the gel fraction is calculated in the above calculation process, the calculation is carried out by excluding the mass of low-molecular-weight organic substance particles except for resin components in the thermosensitive recording layer. At this time, if the mass of low-molecular-weight organic substances has still been unknown, a mass ratio is calculated from the ratio of area occupied per unit area and the specific gravity of each resin and low-molecular-weight organic substance through a cross-sectional observation such as TEM or SEM; the mass of the low-molecular-weight organic substances is calculated; and the value of gel fraction is then calculated.

If a reversible thermosensitive recording layer is provided on a support, and other layers such as protective layers stacked thereon at a time when the gel fraction is measured, and if other layers exist between the support and the reversible thermosensitive recording layer, first the thicknesses of the reversible thermosensitive recording layer and other layers are examined through a cross-sectional observation such as TEM or SEM as described above; the surface is scraped off by an amount equivalent to the thicknesses of the other layers to expose the surface of the reversible thermosensitive recording layer; and the reversible thermosensitive recording layer is separated to carry out a gel fraction measurement in the same way as the above measurement method.

According to the above method, if an ultraviolet curing resin and other layers exist on the reversible thermosensitive recording layer, in order to prevent the layers from becoming blended therein as much as possible, the surface needs to be scraped off by an amount equivalent to the thicknesses of the layers, and the surface of the reversible thermosensitive recording layer, too, needs to be slightly scraped off to avoid affecting the value of gel fraction.

—Control Agent—

The control agent (decoloring accelerator) is not specifically restricted, and can be selected appropriately according to the purpose. However, in terms of color optical density and erasing characteristics, the following compound is preferred: a compound that contains, as a substructure, an amide group, a urethane group, a urea group, a ketone group, or a diacylhydrazide group. Among the above, a compound containing an amide group, a secondary amide group or a urethane group is more preferred. As a concrete example, the following can be listed:
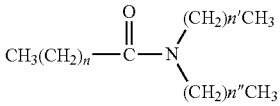
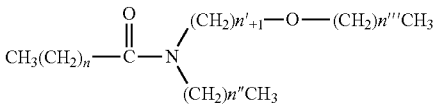
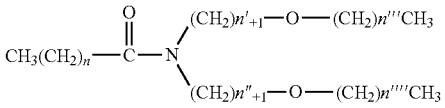
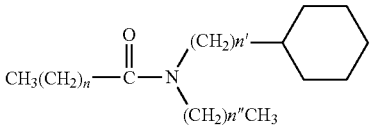
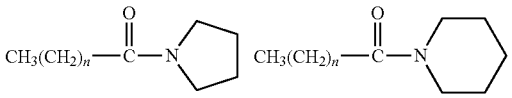
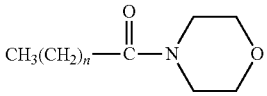
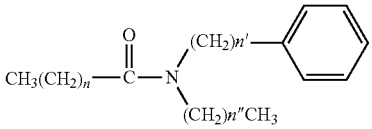
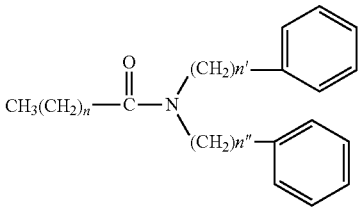
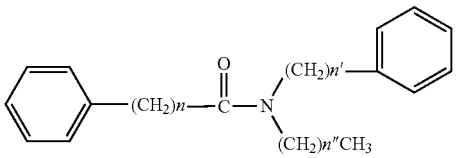
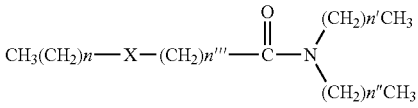
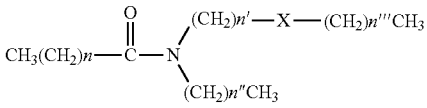
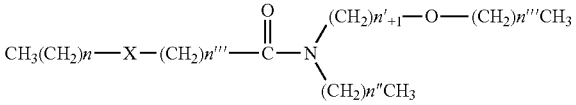
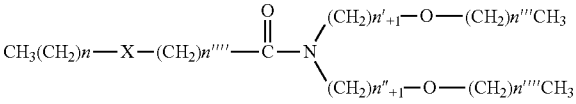
-continued
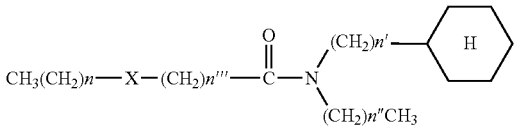
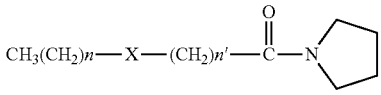
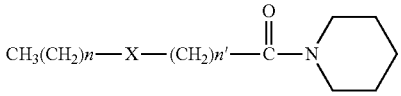
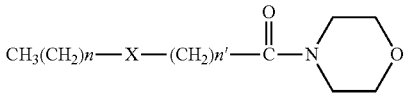
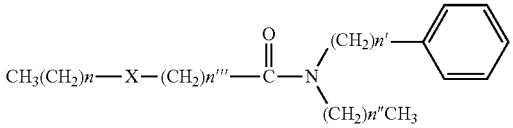
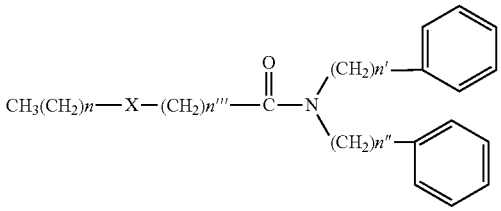
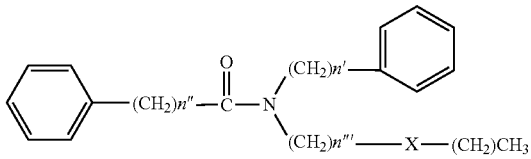
In the formulae, n, n', n'', n''', and n'''' represent an integer ranging from 0 to 21. However, n, n', n'', n''', and n'''' do not all become less than or equal to 5.
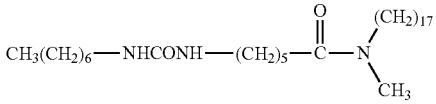
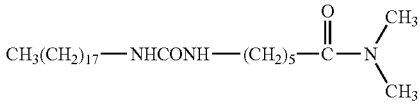
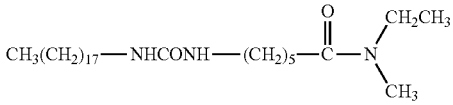
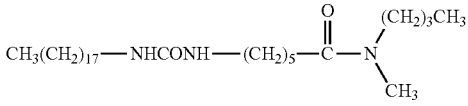
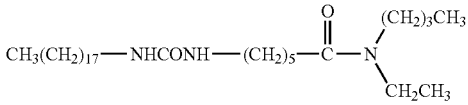
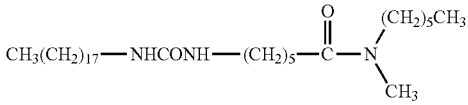

-continued

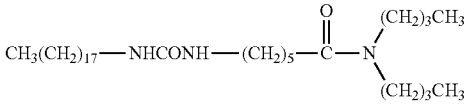

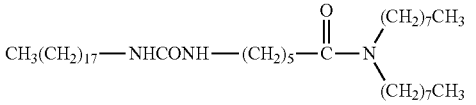

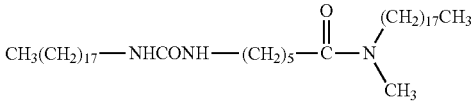

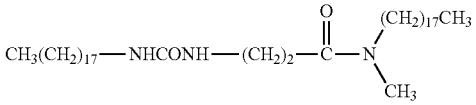

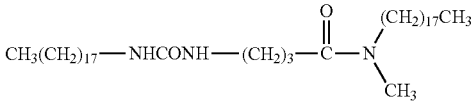

$C_{11}H_{23}CONHC_{12}H_{25}$, $C_{15}H_{31}CONHC_{16}H_{33}$,
$C_{17}H_{35}CONHC_{18}H_{37}$, $C_{17}H_{35}CONHC_{18}H_{35}$,
$C_{21}H_{41}CONHC_{18}H_{37}$, $C_{15}H_{31}CONHC_{18}H_{37}$,
$C_{17}H_{35}CONHCH_2HNOCC_{17}H_{35}$,
$C_{11}H_{23}CONHCH_2HNOCC_{11}H_{23}$,
$C_7H_{15}CONHC_2H_4HNOCC_{17}H_{35}$,
$C_9H_{19}CONHC_2H_4HNOCC_9H_{19}$,
$C_{11}H_{23}CONHC_2H_4HNOCC_{11}H_{23}$,
$C_{17}H_{35}CONHC_2H_4HNOCC_{17}H_{35}$, $(CH_3)_2$
$CHC_{14}H_{35}CONHC_2H_4HNOCC_{14}H_{35}(CH_3)_2$,
$C_{21}H_{43}CONHC_2H_4HNOCC_{21}H_{43}$,
$C_{17}H_{35}CONHC_6H_{12}HNOCC_{17}H_{35}$,
$C_{21}H_{43}CONHC_6H_{12}HNOCC_{21}H_{43}$,
$C_{17}H_{33}CONHCH_2HNOCC_{17}H_{33}$,
$C_{17}H_{33}CONHC_2H_4HNOCC_{17}H_{33}$,
$C_{21}H_{41}CONHC_2H_4HNOCC_{21}H_{41}$,
$C_{17}H_{33}CONHC_6H_{12}HNOCC_{17}H_{33}$,
$C_8H_{17}NHCOC_2H_4CONHC_{18}H_{37}$,
$C_{10}H_{21}NHCOC_2H_4CONHC_{10}H_{21}$,
$C_{12}H_{25}NHCOC_2H_4CONHC_{12}H_{25}$,
$C_{18}H_{37}NHCOC_2H_4CONHC_{18}H_{37}$,
$C_{21}H_{43}NHOCC_2H_4CONHC_{21}H_{43}$,
$C_{18}H_{37}NHOCC_6H_{12}CONHC_{18}H_{37}$,
$C_{18}H_{35}NHCOC_4H_8CONHC_{18}H_{35}$,
$C_{18}H_{35}NHCOC_8H_{16}CONHC_{18}H_{35}$,
$C_{12}H_{25}OCONHC_{18}H_{37}$, $C_{13}H_{27}OCONHC_{18}H_{37}$,
$C_{16}H_{33}OCONHC_{18}H_{37}$, $C_{18}H_{37}OCONHC_{18}H_{37}$,
$C_{21}H_{43}OCONHC_{18}H_{37}$, $C_{12}H_{25}OCONHC_{16}H_{33}$,
$C_{13}H_{27}OCONHC_{16}H_{33}$, $C_{16}H_{33}OCONHC_{16}H_{33}$,
$C_{18}H_{37}OCONHC_{16}H_{33}$, $C_{21}H_{43}OCONHC_{16}H_{33}$,
$C_{12}H_{25}OCONHC_{14}H_{29}$, $C_{13}H_{27}OCONHC_{14}H_{29}$,
$C_{16}H_{33}OCONHC_{14}H_{29}$, $C_{18}H_{37}OCONHC_{14}H_{29}$,
$C_{22}H_{45}OCONHC_{14}H_{29}$, $C_{12}H_{25}OCONHC_{12}H_{37}$,
$C_{13}H_{27}OCONHC_{12}H_{37}$, $C_{16}H_{33}OCONHC_{12}H_{37}$,
$C_{18}H_{37}OCONHC_{12}H_{37}$, $C_{21}H_{43}OCONHC_{12}H_{37}$,
$C_{22}H_{45}OCONHC_{18}H_{37}$,
$C_{18}H_{37}NHCOOC_2H_4OCONHC_{18}H_{37}$,
$C_{18}H_{37}NHCOOC_3H_6OCONHC_{18}H_{37}$,
$C_{18}H_{37}NHCOOC_4H_8OCONHC_{18}H_{37}$,
$C_{18}H_{37}NHCOOC_6H_{12}OCONHC_{18}H_{37}$,
$C_{18}H_{37}NHCOOC_8H_{16}OCONHC_{18}H_{37}$,
$C_{18}H_{37}NHCOOC_2H_4OC_2H_4OCONHC_{18}H_{37}$,
$C_{18}H_{37}NHCOOC_3H_6OC_3H_6OCONHC_{18}H_{37}$,
$C_{18}H_{37}NHCOOC_{12}H_{24}OCONHC_{18}H_{37}$,
$C_{18}H_{37}NHCOOC_2H_4OC_2H_4OC_2H_4OCONHC_{18}H_{37}$,
$C_{16}H_{33}NHCOOC_2H_4OCONHC_{16}H_{33}$,
$C_{16}H_{33}NHCOOC_3H_6OCONHC_{16}H_{33}$,
$C_{16}H_{33}NHCOOC_4H_8OCONHC_{16}H_{33}$,
$C_{16}H_{33}NHCOOC_6H_{12}OCONHC_{16}H_{33}$,
$C_{16}H_{33}NHCOOC_8H_{16}OCONHC_{16}H_{33}$,
$C_{18}H_{37}OCOHNC_6H_{12}NHCOOC_{18}H_{37}$,
$C_{16}H_{33}OCOHNC_6H_{12}NHCOOC_{16}H_{33}$,
$C_{14}H_{29}OCOHNC_6H_{12}NHCOOC_{14}H_{29}$,
$C_{12}H_{25}OCOHNC_6H_{12}NHCOOC_{12}H_{25}$,
$C_{10}H_{21}OCOHNC_6H_{12}NHCOOC_{10}H_{21}$,
$C_8H_{17}OCOHNC_6H_{12}NHCOOC_8H_{17}$

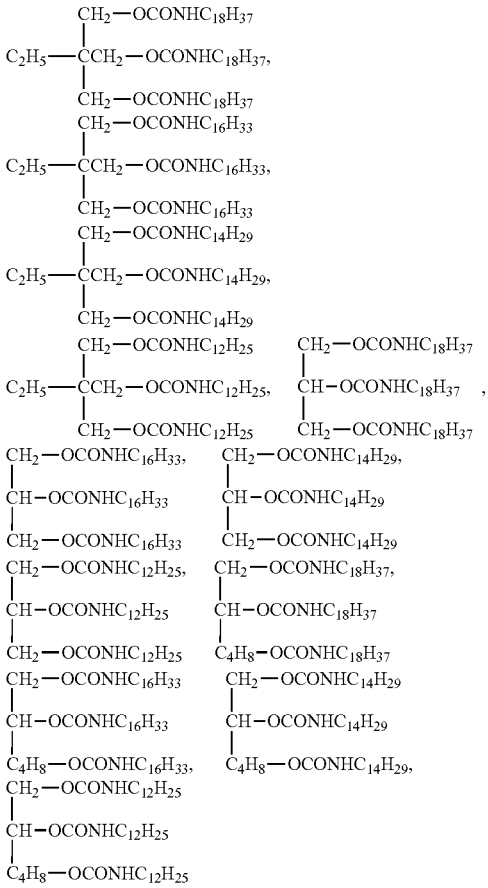

One of the above may be used independently; or alternatively, two or more of the above may be used together.

The amount of the control agent (decoloring accelerator) contained is preferably 0.1 parts by mass to 300 parts by mass relative to 100 parts by mass of the electron-accepting compound (developer), more preferably 3 parts by mass to 100 parts by mass. When being mixed with the electron-donating color-forming compound (color former) and the electron-accepting compound (developer), the control agent is evenly mixed with the compounds.

The reversible thermosensitive recording layer of the reversible thermosensitive recording medium of the present invention is made up of a composition in which, in the binder resin, the electron-donating color-forming compound (color former) and the electron-accepting compound (developer) are being dispersed finely and evenly. The electron-donating color-forming compound (color former) and the electron-accepting compound (developer) may separately form particles. However, it is more preferred that a dispersed state be formed as composite particles. The dispersed state can be achieved by melting or dissolving the electron-donating color-forming compound (color former) and the electron-accepting compound (developer). Such a reversible thermosensitive composition can be applied to the surface of the support as a mixed liquid, which is obtained as materials are each dispersed or dissolved in a corresponding solvent and then mixed, or as a mixed liquid, which is obtained as materials are each mixed and then dispersed or dissolved in a solvent. The electron-donating color-forming compound (color former) and the electron-accepting compound (developer) may be stored in a microcapsule before being used.

The reversible thermosensitive composition is an coating liquid, which is prepared by evenly mixing and dispersing a mixture of an electron-donating color-forming compound (color former), an electron-accepting compound (developer), various additive agents, a curing agent, a crosslinked resin, and an coating-liquid solvent.

The solvent used for preparing the coating liquid is not specifically restricted, and can be selected appropriately according to the purpose. For example, the following can be listed: water; alcohols such as methanol, ethanol, isopropanol, n-butanol, and methylisocarbinol; ketones such as acetone, 2-butanone, ethyl amyl ketone, diacetone alcohol, isophorone, and cyclohexanone; amides such as N,N-dimethylformamide and N,N-dimethylacetamide; ethers such as diethyl ether, isopropyl ether, tetrahydrofuran, 1,4-dioxane, and 3,4-dihydro-2H-pyran; glycol ethers such as 2-methoxyethanol, 2-ethoxyethanol, 2-butoxyethanol, and ethylene glycol dimethyl ether; glycol ether acetates such as 2-methoxy ethyl acetate, 2-ethoxy ethyl acetate, and 2-butoxyethyl acetate; esters such as methyl acetate, ethyl acetate, isobutyl acetate, amyl acetate, ethyl lactate, and ethylene carbonate; aromatic hydrocarbons such as benzene, toluene, and xylene; aliphatic hydrocarbons such as hexane, heptane, iso-octane, and cyclohexane; halogenated hydrocarbons such as methylene chloride, 1,2-dichloroethane, dichloropropane, and chlorobenzene; sulfoxides such as dimethyl sulfoxide; pyrrolidones such as N-methyl-2-pyrrolidone, and N-octyl-2-pyrrolidone.

The coating liquid can be prepared using a well-known coating-liquid dispersing device such as a paint shaker, ball mill, attritor, triple roll mill, Kedy mill, sand mill, dyno mill, and colloid mill. Each material may be dispersed in a solvent by using the coating-liquid dispersing device; or alternatively, each may be independently dispersed in a solvent and mixed. Furthermore, a heating and dissolution process may take place, followed by a rapid cooling or cold removal process, to bring about precipitation.

<<Forming Reversible Thermosensitive Recording Layer>>

In order to form the reversible thermosensitive recording layer on the support, there is no specific restriction; a conventional, well-known method may be used. For example, a coating liquid of the reversible thermosensitive composition is applied to the surface of the support before being dried. As for the method of applying the coating liquid of the reversible thermosensitive composition, for example, the following can be listed: blade coating, wire bar coating, spray coating, air knife coating, bead coating, curtain coating, gravure coating, kiss coating, reverse roll coating, dip coating, and die coating.

After the coating liquid of the reversible thermosensitive composition is applied, a drying process, as well as a hardening process if necessary to complete the cross-linking of the binder resin, is carried out. The drying and hardening processes may be carried out with the use of a constant temperature oven at relatively high temperatures for a short period of time; or alternatively, a thermal process may be carried out at relatively low temperatures for a long period of time. The hardening-reaction conditions are not specifically restricted, and can be selected appropriately according to the purpose. In terms of reactivity, it is preferred that heating take place at about 30° C. to about 130° C. for about one minute to about 150 hours. It is more preferred that heating take place at 40° C. to 100° C. for about two minutes to about 120 hours. Moreover, a crosslinking process may be provided separately from the drying process. The conditions for the crosslinking process are not specifically restricted, and can be selected appropriately according to the purpose. However, it is preferred that heating take place at 40° C. to 100° C. for about two minutes to about 120 hours.

The thickness of the reversible thermosensitive recording layer varies according to the types of the electron-donating color-forming compound (color former) and of the electron-accepting compound (developer). The thickness of the reversible thermosensitive recording layer is not specifically restricted, and can be selected appropriately according to the purpose. The thickness is preferably 1 μm to 20 μm, more preferably 3 μm to 15 μm. If the thickness of the reversible thermosensitive recording layer is less than 1 μm, the contrast may be insufficient when coloring takes place. If the thickness is over 20 μm, there can be a decrease in the heat sensitivity of the reversible thermosensitive recording layer.

<Metallic Compound-Containing Layer (Gas Barrier Layer)>

The metallic compound-containing layer (gas barrier layer) at least contains a resin, an organometallic compound, and an inorganic layered compound, as well as other components if necessary.

The metallic compound-containing layer (gas barrier layer) covers the reversible thermosensitive recording layer, having a function of preventing the fading or changing in color of the reversible thermosensitive recording layer, which could occur as oxygen gets into the reversible thermosensitive recording layer and the electron-donating color-forming compound (color former) and the electron-accepting compound (developer) react with each other. In particular, as the reversible thermosensitive recording medium is going to be used for a longer period of time, there is a need to further improve the gas-barrier properties of the metallic compound-containing layer (gas barrier layer). By preventing oxygen from getting into the reversible thermosensitive recording layer, the reversible thermosensitive recording medium is excellent in light resistance, able to prevent the fading and changing of color for a long period of time.

The thickness of the metallic compound-containing layer (gas barrier layer) varies according to the oxygen permeation characteristics of the metallic compound-containing layer (gas barrier layer). The thickness of the metallic compound-containing layer is not specifically restricted, and can be selected appropriately according to the purpose. The thickness is preferably 0.1 μm to 10 μm, more preferably 0.3 μm to 5 μm. If the thickness of the metallic compound-containing layer (gas barrier layer) is less than 0.1 μm, the oxygen-barrier properties and the moisture-barrier properties may be insufficient. If the thickness is over 10 μm, there can be a decrease in the sensitivity of the reversible thermosensitive recording layer to a heating head.

The metallic compound-containing layer (gas barrier layer) may be a single layer, or a plurality of layers. The metallic compound-containing layer (gas barrier layer) consisting of a plurality of layers is favorable in terms of gas-barrier reliability.

<<Resin>>

The resin is not specifically restricted as long as the resin contains at least one type selected from among groups consisting of polyvinyl alcohol polymers and ethylene-vinyl alcohol copolymers, and can be selected appropriately according to the purpose (or according to the way the resin is used, oxygen permeability, transparency, characteristics of mixing with inorganic layered compounds, characteristics of adhesiveness to the thermosensitive recording layer, humidity resistance, or ease of coating). A resin having a high level of visible light transmittance is preferred.

For the resin, a polyvinyl alcohol polymer having gas-barrier properties may be used. Moreover, the following may also be used for the resin: an ethylene-vinyl alcohol copolymer that has not only gas-barrier properties but also humidity resistance, or a composition of gas-barrier resins having the above properties.

The polyvinyl alcohol polymer is not specifically restricted, and can be selected appropriately according to the purpose. The following can be listed: polyvinyl alcohol, a derivative of polyvinyl alcohol, and a modified product of polyvinyl alcohol. One of the above may be used independently; or alternatively, two or more of the above may be used together.

The derivative of polyvinyl alcohol is not specifically restricted, and can be selected appropriately according to the purpose. A polyvinyl alcohol derivative in which about 40% by mole of hydroxyl groups have been acetalized can be listed.

The modified product of polyvinyl alcohol is not specifically restricted, and can be selected appropriately according to the purpose. The following can be listed: a modified product of polyvinyl alcohol, which can be obtained by co-polymerizing a carboxyl group-containing monomer, an amino group-containing monomer.

The degree of polymerization of the polyvinyl alcohol polymer is not specifically restricted, and can be selected appropriately according to the purpose. The degree is preferably 100 to 5,000, more preferably 500 to 3,000.

The degree of saponification of the polyvinyl alcohol polymer is not specifically restricted, and can be selected appropriately according to the purpose. The degree is preferably greater than or equal to 60% by mole, more preferably greater than or equal to 75% by mole.

Incidentally, one of the advantages of the polyvinyl alcohol polymer is that the gas-barrier properties thereof are extremely high in a dry state. However, the rate at which the gas-barrier properties decrease under high humidity is larger than that of the ethylene-vinyl alcohol copolymer. Accordingly, when being used under high humidity, the polyvinyl alcohol polymer preferably contains a large amount of inorganic layered compounds, which are described later, at a time when the metallic compound-containing layer (gas barrier layer) is formed.

The ethylene-vinyl alcohol copolymer is not specifically restricted, and can be selected appropriately according to the purpose. However, a resin obtained by saponifying an ethylene-vinyl acetate copolymer is preferred. The resin obtained by saponifying the ethylene-vinyl acetate copolymer is not specifically restricted, and can be selected appropriately according to the purpose. For example, the following can be listed: a resin that is obtained by saponifying an ethylene-vinyl acetate copolymer obtained by co-polymerize ethylene and vinyl acetate, a resin that is obtained by saponifying an ethylene-vinyl acetate copolymer obtained by co-polymerizing ethylene, vinyl acetate and other monomers.

The ethylene ratio of a not-yet-copolymerized monomer of the ethylene-vinyl acetate copolymer is not specifically restricted, and can be selected appropriately according to the purpose. However, the ethylene ratio is preferably 20% by mole to 60% by mole. If the ethylene ratio is less than 20% by mole, there can be a decrease in the gas-barrier properties under high humidity. If the ethylene ratio is over 60% by mole, the gas-barrier properties tend to decline.

The ethylene-vinyl alcohol copolymer is not specifically restricted, and can be selected appropriately according to the purpose. However, a resin whose degree of saponification of vinyl acetate components is 95% by mole or more is preferred.

If the degree of saponification of vinyl acetate components is less than 95% by mole, the gas-barrier properties and the oil resistance may be insufficient. As for the ethylene-vinyl alcohol copolymer, a resin that is made lower in molecular weight after being processed by peroxide is preferred because of better dissolution stability in a solvent.

A water-soluble resin, which could be the ethylene-vinyl alcohol copolymer among other things, is poor in water resistance when being used independently because of the water solubility thereof. According to the present invention, an organometallic compound containing at least an organic titanium compound or organic zirconium compound is used as a hardening agent for the water-soluble resin. According to the present invention, since the organometallic compound is highly reactive with the water-soluble resin, a coating layer that is excellent in water resistance can be formed. In the present specification, the organic titanium compound and the organic zirconium compound are respectively compounds having, within a molecule, at least one structure in which an organic group is bonded directly, or via another linkage associated with an oxygen atom, or nitrogen atom, to titanium or zirconium.

As for the organic zirconium compound, for example, the following can be listed: zirconium chelate [General formula: $Zr(OR)_n(X)_{4-n}$, R=organic group, X=ligand, n=integer 0 to 3], zirconium acylate [General formula: $Zr(OR^1)_n(OCOR^2)_{4-n}$, $R^1$, $R^2$=organic groups, n=integer 0 to 3], zirconium alkoxide [General formula: $Zr(OR)_4$, R=organic group]. As for the zirconium chelate, for example, the following can be listed: zirconium tetra-acetylacetonate, zirconium tributoxy acetylacetonate, zirconium monobutoxy acetylacetonate bis ethylacetoacetate, zirconium dibutoxy bis ethylacetoacetate, and zirconium tetra-acetylacetonate. As for the zirconium acylate, for example, the following can be listed: zirconium acetate, and zirconium tributoxy stearate. As for the zirconium alkoxide, for example, the following can be listed: tetranor malpropoxy zirconium, and tetranor malbutoxy zirconium.

As for the organic titanium compound, for example, the following can be listed: titanium chelate [General Formula: $Ti(OR)_n(X)_{4-n}$, R=organic group, X=ligand, n=integer 0 to 3], titanium acylate [General Formula: $Ti(OR^1)_n(OCOR^2)_{4-n}$, $R^1$, $R^2$=organic groups, n=integer 0 to 3], titanalkoxide [General Formula: $Ti(OR)_4$, R=organic group]. As for the titanium chelate, for example, the following can be listed: titanium acetyl acetate, triethanolamine titanate, titanium ammonium lactate, titanium lactate, and titanium diisopropoxy bis(triethanolaminate). As for the titanium acylate, for example, the following can be listed: polyhydroxy titanium stearate, and polyisopropoxy titanium stearate. As for the titanalkoxide, for example, the following can be listed: tetraisopropyl titanate, tetra-n-butyl titanate, tetra-2-ethylhexyl titanate, and tetrastearyl titanate.

The organometallic compound is not specifically restricted, and can be selected appropriately according to the purpose. However, in terms of water resistance and adherence, a chelate compound, or acylate compound is preferred.

The amount of metals (Ti and Zr) contained in the metallic compound-containing layer is not specifically restricted, and can be selected appropriately according to the purpose. However, the amount is preferably 0.1% by mass to 15% by mass, more preferably 0.2% by mass to 10% by mass, or particularly more preferably 2% by mass to 8% by mass.

If the amount of metals contained in the metallic compound-containing layer is less than 0.1% by mass, the adherence may be insufficient. If the amount exceeds 15% by mass, there can be a decrease in the oxygen barrier properties. If the amount of metals contained in the metallic compound-containing layer is within the above particularly-preferable range, the amount is favorable in terms of both adherence and oxygen barrier properties.

The addition of the organometallic compound helps improve the cohesive failure of the metallic compound-containing layer, thereby preventing a pinhole from occurring.

<<Inorganic Layered Compound>>

The inorganic layered compound may be a natural product, or a synthetic product of swelling clay minerals. The inorganic layered compound is not specifically restricted as long as the inorganic layered compound has humidity resistance, and can be selected appropriately according to the purpose. However, what is preferred is an inorganic layered compound whose swelling and cleavage take place in a dispersion medium. The inorganic layered compound whose swelling and cleavage take place in a dispersion medium is not specifically restricted, and can be selected appropriately according to the purpose. For example, the following can be listed: a kaolinite group having a 1:1 structure of phyllosilicate, an antigorite group belonging to a serpentine group, a smectite group that depends on the number of interlayer cations, a vermiculite group, which is a hydrous silicate mineral, and a mica group. As a concrete example of the inorganic layered compound whose swelling and cleavage take place in a dispersion medium, the following can be listed: kaolinite, nacrite, dickite, halloysite, hydrated halloysite, antigorite, chrysotile, pyrophyllite, montmorillonite, beidellite, saponite, hectorite, sauconite, stevensite, tetra silicic mica, sodium taeniolite, muscovite, margarite, talc, vermiculite, phlogopite, xanthophyllite, chlorite, and scaly silica. One of the above may be used independently; or alternatively, two or more of the above may be used together. Among the above, montmorillonite and mica are preferred in terms of gas-barrier performance when being used as a gas-barrier layer.

When the inorganic layered compound is a natural product, it is easy to ensure a gas-barrier function because of a relatively large size after being dispersed in the resin. However, inorganic metal ions, a very small amount of which is contained as impurities, could cause the oxidative degradation of the metallic compound-containing layer (gas barrier layer) as heat energy is applied at a time when an image of the reversible thermosensitive recording medium is formed, possibly forming colored components. The above phenomenon is visually confirmed as something that remains unerased at a time when an original formation image of the reversible thermosensitive recording medium is erased, resulting in a remarkable drop in image quality. In order to prevent a decline in the image quality, when the inorganic layered compound, which is a natural product, is mixed with a resin, an alkali metal or alkaline earth metal is preferably added to prevent the oxidative degradation associated with the impurity inorganic metal ions.

When the inorganic layered compound is a synthetic product of swelling clay minerals, almost all of the above impurities are unmixed. Therefore, there is no decrease in the image quality. However, during a synthesis process of the inorganic layered compound, particles become small in diameter, and a gas passage path becomes shorter. As a result, desired gas-barrier properties may not develop. As for the inorganic layered compound, the inorganic layered compound used may be of a natural or synthetic product. The characteristics of substances used are accurately taken into account when the blend ratio of the resin/inorganic layered compound is selected in a way that improves the gas-barrier properties.

The synthetic product is not specifically restricted, and can be selected appropriately according to the purpose. The following can be listed: synthetic mica, mica that is obtained by carrying out physical or chemical treatment to natural mica.

The shape of the inorganic layered compound is not specifically restricted, and can be selected appropriately according to the purpose. For example, the length and width thereof each are preferably 5 nm to 5,000 nm, more preferably 10 nm to 3,000 nm. The thickness thereof is preferably about 1/10 to about 1/10,000 of the length with a plate-like shape, more preferably about 1/50 to about 1/5,000 with a plate-like shape.

If the length or width of the inorganic layered compound is over 5,000 nm, the unevenness of mixing can more likely occur in the metallic compound-containing layer (gas barrier layer); it is difficult to mix evenly, and it may be difficult to form a thin film. If the length or width of the inorganic layered compound is less than 5 nm, the inorganic layered compound becomes arranged parallel to the metallic compound-containing layer (gas barrier layer) in the metallic compound-containing layer (gas barrier layer), and is therefore less likely to be dispersed, possibly leading to a decrease in gas-barrier properties. If the thickness of the inorganic layered compound is over 1/10 of the length, the inorganic layered compound becomes arranged parallel to the metallic compound-containing layer (gas barrier layer) in the metallic compound-containing layer (gas barrier layer), and is therefore less likely to be dispersed, possibly leading to a decrease in gas-barrier properties.

The mass ratio of the resin to the inorganic layered compound in the metallic compound-containing layer (gas barrier layer) is not specifically restricted, and can be selected appropriately according to the purpose. However, the mass ration is preferably 95/5 to 50/50, more preferably 90/10 to 65/35. If the mass ratio of the inorganic layered compound is less than 5, the gas barrier properties are insufficient, having an insufficient effect thereof. If the mass ratio of the inorganic layered compound is over 50, the strength of the coating film and the adhesiveness to other layers are insufficient, possibly causing separation and a decline in transparency. Here, a partial separation in the metallic compound-containing layer (gas barrier layer) is likely to cause the bleaching of the reversible thermosensitive recording medium.

In the metallic compound-containing layer (gas barrier layer), it is preferred that the inorganic layered compound be arranged in parallel along a layer direction of the metallic compound-containing layer (gas barrier layer) and be dispersed.

Figure 3:
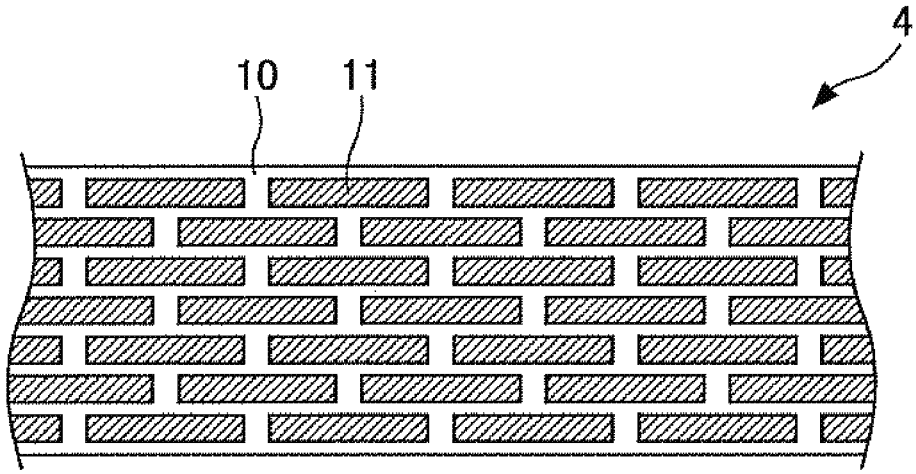
FIG. 3 is a cross-sectional view of a metallic compound layer in a reversible thermosensitive recording medium according to the present invention.

FIG. 3 is a schematic cross-sectional view of a metallic compound-containing layer (gas barrier layer) 4 in a reversible thermosensitive recording medium according to the present invention.

When inorganic layered compounds 11 are dispersed in a solvent and a dispersing liquid of gas barrier resin, and are formed as a thin metallic compound-containing layer (gas barrier layer) 4, as shown in FIG. 3, the inorganic layered compounds 11 tend to become arranged flatly along a layer direction in a gas barrier resin 10. When the inorganic layered compounds 11 become arranged in layers along the layer direction in the metallic compound-containing layer (gas barrier layer) 4 as described above, gaseous molecules such as oxygen and water vapor gas pass through in a way that circumvents the inorganic layered compounds 11 as the gaseous molecules pass through the metallic compound-containing layer (gas barrier layer) 4 in the vertical direction. In this case, a route for the gaseous molecules to pass through the metallic compound-containing layer (gas barrier layer) 4 is extremely longer than the vertical distance of the cross section of the metallic compound-containing layer (gas barrier layer) 4. The gas barrier resin 10, which forms the metallic compound-containing layer (gas barrier layer) 4, inherently includes gas-barrier properties. Therefore, as the passage route becomes longer, the gas barrier properties of the metallic compound-containing layer (gas barrier layer) 4 increase proportionally.

As described above, the inorganic layered compounds 11 become dispersed in the metallic compound-containing layer (gas barrier layer) 4 and particularly become dispersed in parallel along the layer direction. Therefore, the moisture barrier properties, as well as oxygen barrier properties, of the metallic compound-containing layer (gas barrier layer) 4 improve. In particular, the gas barrier resin 10 that is excellent in oxygen barrier properties, such as polyvinyl alcohol, has moisture absorption properties, but insufficient oxygen barrier properties under high humidity. However, when the inorganic layered compounds 11 are added to the gas barrier resin 10, the metallic compound-containing layer (gas barrier layer) 4 can achieve excellent oxygen barrier properties not only under low humidity but also under high humidity. Furthermore, it is possible to prevent the deterioration associated with the moisture absorption of the gas barrier resin, as well as to prevent the metallic compound-containing layer (gas barrier layer) 4 from being separated from the thermosensitive recording layer.

The inorganic layered compounds exist so as to be oriented in the layer direction of the gas barrier layer in the gas barrier resin. Therefore, it is possible to improve the gas barrier properties of the gas barrier layer.

<<Adhesion Improvement Agent>>

The metallic compound-containing layer (gas barrier layer) contains an inorganic layered compound. Therefore, in order to improve the adhesiveness to adjoining layers, such as a thermosensitive recording layer and a protective layer, an adhesion improvement agent may be added. As for the basic properties of the reversible thermosensitive recording medium, in order to enable the reversible thermosensitive recording medium to undergo repeated processes of heating and cooling, i.e. forming and erasing of recording images that are performed many times, one of, or two or more of the following adhesion improvement agents for adjoining layers can be added when necessary: a silane coupling agent, a titanate coupling agent, an isocyanate compound, an aziridine compound, and a carbodiimide compound.

The silane coupling agent is not specifically restricted, and can be selected appropriately according to the purpose. For example, the following can be listed: alkoxysilane having a vinyl group, such as vinyl trimethoxysilane, vinyl triethoxysilane, N-β-(N-vinylbenzylaminoethyl)-γ-aminopropyltrimethoxysilane, vinyltriacetoxysilane, and 3-methacrylic acid propyl trimethoxysilane; alkoxysilane having an epoxy group, such as 3-glycidoxypropyltrimethoxysilane, 3-glycidoxypropyl methyl dimethoxy silane, 2-(3,4-epoxycyclohexyl)ethyltrimethoxysilane; alkoxysilane having an amino group and/or an imino group, such as 3-aminopropyltriethoxysilane, 3-N-(2-aminoethyl)aminopropyltrimethoxysilane, 3-N-(2-aminoethyl)aminopropyl methyl dimethoxy silane; isocyanate alkoxysilane, such as triethoxysilyl propyl isocyanate; alkoxysilane having a mercapto group, such as γ-mercaptopropyltrimethoxysilane; alkoxysilane having a ureido group, such as γ-ureido propyl triethoxysilane. Among the above, in terms of faster speeds of reaction with organic residues adjacent to the metallic compound-containing layer (gas barrier layer), a trialkoxysilane compound having an amino group and a trialkoxysilane compound having a mercapto group are preferred. In terms of faster speeds of chemical reaction with inorganic layered compounds in the metallic compound-containing layer (gas barrier layer), it is more preferred that an alkyl group of a trialkoxysilyl group be a methyl group.

The aziridine compound is not specifically restricted, and can be selected appropriately according to the purpose. For example, the following can be listed: trimethylolpropane tris(3-aziridinylpropionate), trimethylolpropane tris[3-(2-methyl-aziridinyl)-propionate], trimethylolpropane tris(2-aziridinylbutyrate), tris(1-aziridinyl) phosphine oxide, pentaerythritol tris-3-(1-aziridinylpropionate), pentaerythritol tetrakis-3-(1-aziridinylpropionate) and 1,6-bis(1-aziridinocarbamoyl) hexamethylenediamine.

The isocyanate compound is not specifically restricted, and can be selected appropriately according to the purpose. For example, the following can be listed: aliphatic or cycloaliphatic diisocyanate, such as hydrogenated toluene diisocyanate (hydrogenated TDI), hydrogenated xylylene diisocyanate (hydrogenated XDI), hydrogenated 4,4'-diisocyanate diphenylmethane (hydrogenated MDI), hexamethylenediisocyanate (HDI), isophorone diisocyanate (IPDI), and xylylene diisocyanate (XDI); polyisocyanate having three or more functional groups, such as a burette type, isocyanurate type and adduct type, which are derivatives of the above; an aliphatic isocyanate compound, such as various types of oligomer and polymer containing isocyanate; aromatic diisocyanate, such as phenylene diisocyanate (PDI), toluene diisocyanate (TDI), naphthalene diisocyanate (NDI), 4,4'-diisocyanate diphenylmethane (MDI); polyisocyanate having three or more functional groups, such as a burette type, isocyanurate type and adduct type, which are derivatives of the above; an aromatic isocyanate compound, such as various types of oligomer and polymer containing isocyanate. In order to form the metallic compound-containing layer (gas barrier layer), given that a water-soluble polymer is used together and that a gas-barrier coating composition basically contains water as a solvent, it is preferred that the reaction with water be suppressed, and a hardening process go on after a film is formed. Therefore, what is more preferred is a polyisocyanate compound of a self-emulsification type, which exists in a water-dispersed state after a hydrophilic group is introduced into a skeleton of the isocyanate compound. Furthermore, it is more preferred that a hydrophobic group be introduced in order to further inhibit the reaction with water before a film is formed.

The carbodiimide compound is not specifically restricted, and can be selected appropriately according to the purpose. However, a water-dispersion emulsion type is preferred. The hydrophilic degeneration of the carbodiimide compound is not specifically restricted, and can be selected appropriately according to the purpose. However, in terms of a better balance of stability and cross linkage, what is preferred is a substance obtained by carrying out chain elongation through a urethane reaction between an isocyanate-terminal carbodiimide compound and a polyol compound and then hydrophilic degeneration of the molecules' ends with a hydrophilic oligomer.

<<Method of Forming Metallic Compound-Containing Layer (Gas Barrier Layer)>>

The method of forming the metallic compound-containing layer (gas barrier layer) is not specifically restricted as long as the reversible thermosensitive composition can be applied, and can be selected appropriately according to the purpose. For example, a method of applying the reversible thermosensitive composition and heating and drying, and other methods can be listed.

The method of applying the reversible thermosensitive composition is not specifically restricted, and can be selected appropriately according to the purpose. For example, the following can be listed: a roll coating method that uses a gravure cylinder, a doctor knife method, an air knife/nozzle coating method, a bar coating method, a spray coating method, and a dip coating method. One of the above methods may be used independently; or alternatively, two ore more may be used together.

In the metallic compound-containing layer (gas barrier layer), it is preferred that the inorganic layered compound become arranged in parallel along the metallic compound-containing layer (gas barrier layer) and be dispersed. In that regard, when the metallic compound-containing layer (gas barrier layer) is formed by the above application method for the reversible thermosensitive composition, it is likely that the inorganic layered compound becomes arranged in parallel along the metallic compound-containing layer (gas barrier layer) and is dispersed.

When the metallic compound-containing layer (gas barrier layer) is formed by the above application method, as for a method of producing a reversible thermosensitive composition for the application process, for example, the following and other methods can be listed:

(1) A method of adding and mixing an inorganic layered compound (whose swelling and cleavage may be completed in advance in a dispersion medium such as water) with a solution that is obtained by dissolving a resin (gas-barrier resin) and an organometallic compound in a solvent, and dispersing the inorganic layered compound using a stirring or dispersing device; and (2) A method of adding and mixing a solution, which is obtained by dissolving a gas-barrier resin and an organometallic compound in a solvent, with a dispersing liquid (dispersion solution) in which the swelling and cleavage of an inorganic layered compound are first performed in a dispersion medium such as water before being further carried out with the use of a stirring or dispersing device.

When the inorganic layered compound is a natural product, for example, a compound containing alkali metal ions or alkaline-earth metal ions, such as magnesium hydroxide or calcium hydroxide, is preferably added in advance to the mixed liquid.

The solvent of the resin and the organometallic compound is not specifically restricted, and can be selected appropriately according to the purpose. For example, the following can be listed: aqueous and non-aqueous solvents, which can dissolve a polyvinyl alcohol polymer and/or ethylene-vinylalcohol copolymer and an organometallic compound. Among the above, because of no toxicity to the environment, water is preferred. Incidentally, as for the ethylene-vinylalcohol copolymer, in order to add solubility, it is preferred that a lower alcohol having 2 carbon atoms to 4 carbon atoms be used together with the ethylene-vinylalcohol copolymer.

Moreover, when the ethylene-vinylalcohol copolymer is used as a resin, it is preferred that a gas-barrier resin solution be formed with the use of a mixed solvent of a terminal-modified ethylene-vinylalcohol copolymer, whose molecular weight is lowered after being processed by a peroxide, water and lower alcohol. In this case, when a mixed solvent that contains 50% by mass to 85% by mass of water and 15% by mass to 50% by mass of lower alcohol containing 2 carbon atoms to 4 carbon atoms is used, the ethylene-vinylalcohol copolymer is improved in solubility, and is favorable to maintaining moderate amounts of solids. If the amount of lower alcohol contained in the mixed solvent exceeds 50% by mass, the cleavage could be insufficient when the inorganic layered compound becomes dispersed.

The lower alcohol containing 2 carbon atoms to 4 carbon atoms is not specifically restricted, and can be selected appropriately according to the purpose. For example, the following can be listed: ethyl alcohol, n-propyl alcohol, iso-propyl alcohol, n-butyl alcohol, iso-butyl alcohol, sec-butyl alcohol and tert-butyl alcohol. One of the above alcohols may be used independently; or alternatively, two or more may be used together.

Among the above, n-propyl alcohol and iso-propyl alcohol are particularly preferred.

The stirring device and the dispersing device, which are used to form a reversible thermosensitive composition, are not specifically restricted as long as the devices are typical stirring and dispersing devices able to evenly disperse inorganic layered compounds in a dispersing liquid, and can be selected appropriately according to the purpose. Given that a transparent, stable inorganic layered compound dispersion liquid can be obtained, a high-pressure dispersing device and an ultrasonic dispersing device are preferred. The high-pressure dispersing device is not specifically restricted, and can be selected appropriately according to the purpose. For example, the following can be listed: Nanomizer (manufactured by NANOMIZER), Microfluidizer (manufactured by Microfluidics), Ultimizer (manufactured by SUGINO MACHINE), DeBee (manufactured by Bee) and Niro Soavi Homogenizer (manufactured by Niro Soavi). A pressure condition of the high-pressure dispersing device is not specifically restricted, and can be selected appropriately according to the purpose. However, the pressure condition is preferably 1 MPa to 100 MPa. If the pressure condition of the high-pressure dispersing device is less than 1 MPa, there would be no progress in dispersing inorganic layered compounds. Therefore, the problem could arise that it takes a considerable amount of time to disperse. If the pressure condition exceeds 100 MPa, the inorganic layered compounds can more easily become crushed and too finely divided, making the gas passage path shorter in length and therefore leading to a decline in the intended gas barrier properties.

The adhesion improvement agents, i.e. a silane coupling agent, isocyanate compound, aziridine compound and carbodiimide compound, which are added to improve the adhesiveness to the metallic compound-containing layer (gas barrier layer) and the adjoining layers thereof, may be added after the resin (gas barrier resin) and the inorganic layered compound are dispersed and prepared. In this manner, the metallic compound-containing layer (gas barrier layer) is formed. As a result, there is a significant improvement in the gas-barrier properties of the reversible thermosensitive recording medium, as well as in the resistance to separations associated with the effects of moisture.

<Thermosetting Resin-Containing Layer (Primer Layer)>

The thermosetting resin-containing layer (primer layer) is a layer designed to improve the adhesiveness and adherence with the metallic compound-containing layer (gas barrier layer) and the protective layer; and is a layer containing a hardened material of a thermosetting resin composition that has a strong affinity with the metallic compound-containing layer (gas barrier layer) and the protective layer. The thermosetting resin-containing layer is obtained by, for example, applying a mixed composition (thermosetting resin composition) of a thermosetting resin and a hardening agent (crosslinking agent) to the metallic compound-containing layer (gas barrier layer) and hardening.

The combination of the thermosetting resin and the hardening agent is not specifically restricted, and can be selected appropriately according to the purpose. For example, the following and other combinations can be listed: a polyvinyl butyral resin and isocyanate, an acrylic polyol resin and isocyanate, a polyester polyol resin and isocyanate, a polyurethane polyol resin and isocyanate, a phenoxy resin and isocyanate, and a polyvinyl butyral resin and isocyanate. Among the above combinations, the combination of polyvinyl butyral resin and isocyanate is preferred.

The isocyanate is not specifically restricted, and can be selected appropriately according to the purpose. For example, the following can be listed: tolylene diisocyanate (TDI), 4,4'-diphenylmethane diisocyanate (MDI), xylylene diisocyanate (XDI), naphthylene diisocyanate (NDI), paraphenylene diisocyanate (PPDI), tetramethyl xylylene diisocyanate (TMXDI), hexamethylene diisocyanate (HDI), dicyclohexylmethane diisocyanate (HMDI), isophorone diisocyanate (IPDI), lysine diisocyanate (LDI), isopropylidene bis(4-cyclohexyl isocyanate) (IPC), cyclohexyl diisocyanate (CHDI) and tolidine diisocyanate (TODI).

The thickness of the thermosetting resin-containing layer is not specifically restricted, and can be selected appropriately according to the purpose. However, the thickness is preferably 0.1 μm to 3 μm, more preferably 0.2 μm to 2 μm. If the thickness of the thermosetting resin-containing layer is less than 0.1 μm, the adhesiveness of the metallic compound-containing layer (gas barrier layer) to the protective layer may not be sufficiently achieved. If the thickness of the thermosetting resin-containing layer is over 3 μm, the reversible thermosensitive recording medium could become thicker even though it is not possible to further improve the adhesiveness of the metallic compound-containing layer (gas barrier layer) to the protective layer.

<Anchor Layer>

The first aim of the anchor layer is to bond the reversible thermosensitive recording layer and the metallic compound-containing layer (gas barrier layer) firmly together. The anchor layer is selected from among materials that do not change the characteristics of the reversible thermosensitive recording medium at a time when coating is carried out, or when the reversible thermosensitive recording medium is being used and stored, or at any other time.

The method of forming the anchor layer is not specifically restricted, and can be selected appropriately according to the purpose. For example, a typical coating method and a typical lamination method can be listed.

The thickness of the anchor layer is not specifically restricted, and can be selected appropriately according to the purpose. The thickness of the anchor layer is preferably 0.1 μm to 10 μm, more preferably 0.1 μm to 3 μm.

If the thickness of the anchor layer is less than 0.1 μm, the adhesiveness could be insufficient. If the thickness is over 10 μm, the heat sensitivity of the recording layer could decrease.

When the metallic compound-containing layer (gas barrier layer) is provided on the reversible thermosensitive recording layer, first an anchoring agent containing a thermosetting resin is applied to the surface of the reversible thermosensitive recording layer to form one anchor layer, or two or more anchor layers. Then, the metallic compound-containing layer (gas barrier layer) is formed. The anchor layers may be provided with a function of improving the adhesiveness of the reversible thermosensitive recording layer and the metallic compound-containing layer (gas barrier layer); a function of preventing the alteration of the reversible thermosensitive recording layer, which could occur as the metallic compound-containing layer (gas barrier layer) is applied; a function of preventing an additive agent contained in the metallic compound-containing layer (gas barrier layer) from being transferred to the reversible thermosensitive recording layer; or a function of preventing an additive agent contained in the reversible thermosensitive recording layer from being transferred to the metallic compound-containing layer (gas barrier layer).

The anchoring agents can be categorized into adhesive agents and narrowly-defined anchoring agents.

The adhesive agents are not specifically restricted, and can be selected appropriately according to the purpose. For example, the following can be listed: various kinds of laminating adhesive agents of an isocyanate, urethane or acrylic type.

The narrowly-defined anchoring agents are not specifically restricted, and can be selected appropriately according to the purpose. For example, the following can be listed: various kinds of laminating anchor coating agents of titanium, isocyanate, imine, polybutadiene, or any other type.

Incidentally, the adhesive agents and the narrowly-defined anchoring agents may contain an adhesiveness-modifying material such as a crosslinking agent.

As for a solvent used for the coating liquid of the anchor layer, a dispersing device for the coating liquid, a binder, a coating method, a drying/hardening method, a well-known coating method that is used for the reversible thermosensitive recording layer and the metallic compound-containing layer (gas barrier layer) can be used.

For example, it is preferred that the anchor layer contain a hardened material of a thermosetting resin composition as in the case of the ester polyol resin and reaction products of isocyanate. The hardened material of the thermosetting resin composition bonds the thermosensitive recording layer and the gas barrier layer firmly together. Therefore, in the state of a precursor (ester polyol resin and isocyanate, for example) that has not yet been thermally-hardened, the hardened material of the thermosetting resin composition is preferably obtained after being applied to one layer (thermosensitive recording layer, for example) and thermally-hardened.

In the case of the anchor layer containing an ester polyol resin and a reaction product of isocyanate, the mass ratio of the isocyanate to the ester polyol resin is preferably 10:100 to 150:100. The anchor layer is preferably 0.1 μm to 10 μm in thickness. If the thickness is less than 0.1 μm, the adhesiveness could be insufficient. If the thickness is greater than 10 μm, there is no increase in the adhesive effect, but there is an effect of thickening the reversible thermosensitive recording material. As a result, the thermal conductivity of the reversible thermosensitive recording material could become worse, or the flexibility could be lost.

—Ultraviolet Absorption Layer—

The ultraviolet absorption layer is a layer that protects the reversible thermosensitive recording layer in a way that keeps the reversible thermosensitive recording layer from being exposed to ultraviolet rays. When being exposed to ultraviolet rays for a long period of time, the materials of the reversible thermosensitive recording layer, particularly the electron-donating color-forming compound (color former) and the electron-accepting compound (developer), could deteriorate and change or fade in color, or could not exhibit a sufficient coloring reaction. Accordingly, it is preferred that the thermosensitive recording layer be protected so as not be exposed to unnecessary ultraviolet rays. For example, in the reversible thermosensitive recording medium, an ultraviolet absorption layer is provided between the reversible thermosensitive recording layer and the anchor layer.

The materials of the ultraviolet absorption layer are not specifically restricted as long as the materials can absorb ultraviolet rays, and can be selected appropriately according to the purpose. For example, the following can be listed: a resin for the anchor layer to which a filler having ultraviolet absorption capabilities is added.

The filler is not specifically restricted, and can be selected appropriately according to the purpose. For example, the following can be listed: an inorganic filler, an organic filler. One of the above may be used independently; or alternatively, two or more may be used together.

The inorganic filler is not specifically restricted, and can be selected appropriately according to the purpose. For example, the following can be listed: calcium carbonate, magnesium carbonate, silicic acid anhydride, hydrous silicic acid, hydrous aluminum silicate, hydrous calcium silicate, alumina, iron oxide, calcium oxide, magnesium oxide, chromium oxide, manganese oxide, silica, talc and mica.

The organic filler is not specifically restricted, and can be selected appropriately according to the purpose. For example, the following can be listed: a silicone resin, a cellulosic resin, an epoxy resin, a nylon resin, a phenol resin, a polyurethane resin, a urea resin, a melamine resin, a polyester resin, a polycarbonate resin, a styrene resin such as styrene, polystyrene, polystyrene-isoprene and styrene vinyl benzene, an acrylic resin such as vinylidene chloride acryl, acrylic urethane and ethylene acryl, a polyethylene resin, a formaldehyde resin such as benzoguanamine formaldehyde and melamine formaldehyde, a polymethyl methacrylate resin and a vinyl chloride resin.

The shape of the filler is not specifically restricted, and can be selected appropriately according to the purpose. For example, the following can be listed: a spherical shape, a granular shape, a tabular shape and an acicular shape.

The amount of the filler contained in the ultraviolet absorption layer is not specifically restricted, and can be selected appropriately according to the purpose. However, in volume fraction, the amount is preferably 5% by volume to 50% by volume.

The thickness of the ultraviolet absorption layer is not specifically restricted, and can be selected appropriately according to the purpose. The thickness of the ultraviolet absorption layer is preferably 0.1 μm to 20 μm. If the thickness of the ultraviolet absorption layer is less than 0.1 μm, the absorption of ultraviolet rays may not be sufficient. If the thickness is over 20 μm, the absorption of ultraviolet rays and the thermal conductivity could decline.

<Support>

The shape, structure, size and other factors of the support are not specifically restricted, and can be selected appropriately according to the purpose. As for the shape, for example, a tabular shape can be listed. As for the structure, a single-layer or layered structure may be used. The size may be appropriately selected according to the size of the reversible thermosensitive recording medium.

As for the materials of the support, for example, the following can be listed: an inorganic material and an organic material. As for the inorganic material, for example, the following can be listed: glass, quartz, silicon, silicon oxide, aluminum oxide, $SiO_2$, and metals. As for the organic material, for example, the following can be listed: paper, a cellulose derivative such as cellulose triacetate, synthetic paper, polyethylene-terephthalate, polycarbonate, polystyrene, and polymethyl methacrylate. One of the above may be used independently; or alternatively, two or more may be used together.

It is preferred that, in order to improve the adhesiveness of the coating layer, the surface of the support be modified by a corona discharge process, an oxidation reaction process (e.g., chromic acid), an etching process, an easy-adhesion process, or an antistatic process. It is preferred that the support turn white as a white pigment, such as titanium oxide is added.

The thickness of the support is not specifically restricted, and can be selected appropriately according to the purpose. The thickness of the support is preferably several micrometers to several millimeters, more preferably 10 μm to 2,000 μm, still more preferably 60 μm to 150 μm.

As for the support, a support of a required thickness may be used independently, or a plurality of the supports may be bonded together. On the same plane as the reversible thermosensitive recording layer, on the opposite plane, in the inside, or in any other place, a magnetic recording layer and an IC chip may be provided. If the reversible thermosensitive recording layer is of a self-supporting type, the use of the support can be omitted.

Moreover, it is preferred that the support have oxygen barrier properties and moisture barrier properties. If the oxygen barrier properties and moisture barrier properties of the support are insufficient, the support may be covered with a metallic compound-containing layer (gas barrier layer) described below.

Incidentally, in general, the support is made of a relatively thick film, or sheet. Therefore, the support is equipped with a sufficient oxygen barrier function and a sufficient moisture barrier function. If the support is not provided with an oxygen barrier function and a moisture barrier function, the support side may be covered with a gas barrier layer described later.

For the reversible thermosensitive recording medium of the present invention, various kinds of additive agent can be used when necessary. The additive agent is not specifically restricted, and can be selected appropriately according to the purpose. For example, the following can be listed: a dispersing agent, a surfactant, a conducting agent, a filler material, a lubricant, an antioxidant, a light stabilizer, an ultraviolet absorber, a color stabilizer, a decoloring accelerator, and a filler.

To the reversible thermosensitive recording layer, the anchor layer, and the metallic compound-containing layer (gas barrier layer), a filler that has ultraviolet absorption capabilities (and does not have ultraviolet barrier capabilities) may be added. The filler is not specifically restricted, and can be selected appropriately according to the purpose. For example, the fillers that are listed as ultraviolet absorbers can be listed. One of the above may be used independently; or alternatively, two or more may be used together.

The shape of the filler is not specifically restricted, and can be selected appropriately according to the purpose. For example, the following can be listed: a spherical shape, a granular shape, a tabular shape, and an acicular shape.

The amount of the filler contained in the metallic compound-containing layer (gas barrier layer) is not specifically restricted, and can be selected appropriately according to the purpose. However, in volume fraction, the amount is preferably 5% by volume to 50% by volume.

To the reversible thermosensitive recording layer, the anchor layer, and the metallic compound-containing layer (gas barrier layer), a lubricant may be added.

The lubricant is not specifically restricted, and can be selected appropriately according to the purpose. For example, the following can be listed: synthetic waxes such as ester wax, paraffin wax and polyethylene wax; vegetable waxes such as hydrogenated castor oil; animal waxes such as beef-tallow hydrogenated oil; higher alcohols such as stearyl alcohol and behenyl alcohol; higher fatty acids such as margaric acid, lauric acid, myristic acid, palmityl acid, stearic acid, behenic acid, and furomen acid; higher fatty acid esters such as fatty acid ester of sorbitan; amides such as stearic acid amide, oleic acid amide, lauric acid amide, ethylene-bis-stearic acid amide, methylene-bis-stearic acid amide, methylol stearic acid amide.

The amount of the lubricant contained in each layer is not specifically restricted, and can be selected appropriately according to the purpose. However, in volume fraction, the amount is preferably 0.1% by volume to 95% by volume, more preferably 1% by volume to 75% by volume.

On the periphery of the support of the reversible thermosensitive recording medium of the present invention, on the back surface, in the inside, or at any other location, a magnetic recording layer or an IC chip may be provided. If an IC chip is provided together with the reversible thermosensitive recording medium of the present invention, the reversible thermosensitive recording medium can also be used as an IC card or IC tag. Moreover, if a magnetic recording layer is provided together with the reversible thermosensitive recording medium of the present invention, the reversible thermosensitive recording medium can also be used as a magnetic card. Besides the above, a reversible thermosensitive recording medium may be created on both sides of one support. An adhesion layer may be provided on the side opposite to the support.

First Embodiment

FIG. 1 shows the configuration of a reversible thermosensitive recording medium according to the first embodiment of the present invention. FIG. 1 is a schematic, partial cross-sectional view showing a reversible thermosensitive recording medium according to the present invention. As shown in FIG. 1, in the reversible thermosensitive recording medium 1, on a surface of a sheet-like support 2, a reversible thermosensitive recording layer 3, a gas barrier layer 4, a primer layer 8, and a protective layer 5 are stacked in that order.

The reversible thermosensitive recording layer 3 is stacked in such a way that the lower surface of the reversible thermosensitive recording layer 3 is in contact with the support 2 having sufficient gas barrier properties, and the upper surface is covered with the gas barrier layer 4, thereby keeping both surfaces from being in direct contact with the outside air. In principle, all that is required is for the reversible thermosensitive recording medium to have a layer made of a thermosensitive recording material capable of repeated coloring and decoloring. However, the color former and developer used for the reversible thermosensitive recording layer 3 are easily affected by light; in particular, when being in an activated state due to light, the color former and the developer are likely to induce a radical reaction with oxygen. As the radical reaction occurs, the reversible thermosensitive recording layer 3 has become colored could be decolored or fade in color, or the reversible thermosensitive recording layer 3 that has become decolored could turn yellow or produce any other color. The gas barrier layer 4 is designed to prevent oxygen in the outside air from getting into the reversible thermosensitive recording layer 3. The primer layer 8 improves the adherence between the gas barrier layer 4 and the protective layer 5, and has the effect of preventing ply separation of the gas barrier layer 4 and the protective layer 5. The protective layer 5 prevents the surfaces of the gas barrier layer 4 and the reversible thermosensitive recording layer 3 from being deformed by the heat and pressure of a thermal head, or prevents a dent from being formed, at a time when printing is carried out with the thermal head to record on the reversible thermosensitive recording medium 1. It is preferred that the protective layer 5 also have a function of protecting the surface of the reversible thermosensitive recording medium against mechanical stress, and moisture.

Second Embodiment

Figure 2:
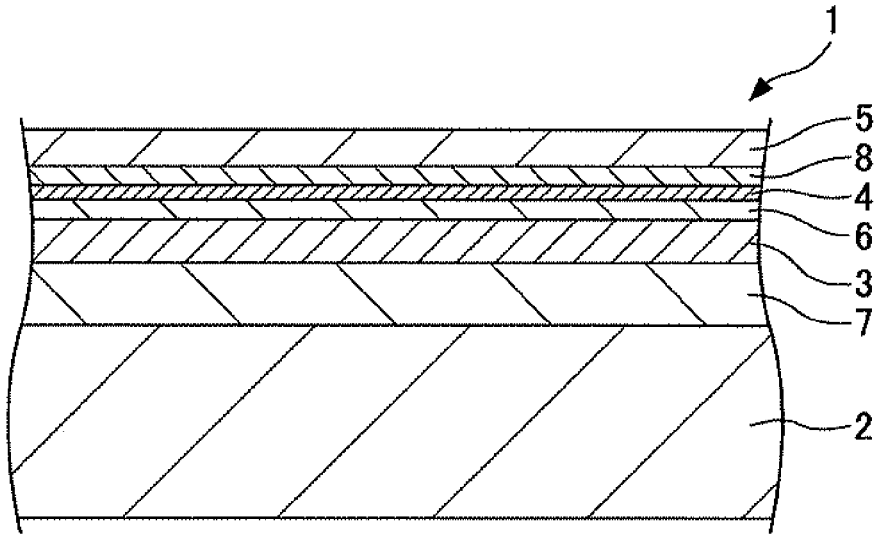
FIG. 2 is a schematic, partial cross-sectional view showing another example of a reversible thermosensitive recording medium according to the present invention.

FIG. 2 shows the configuration of a reversible thermosensitive recording medium according to the second embodiment of the present invention. FIG. 2 is a schematic, partial cross-sectional view showing a reversible thermosensitive recording medium according to the present invention. In a reversible thermosensitive recording medium 1 of the second embodiment shown in FIG. 2, an under layer 7, which is high in thermal insulation, is stacked between a reversible thermosensitive recording layer 3 of the reversible thermosensitive recording medium 1 and a support 2.

Third Embodiment

The reversible thermosensitive recording medium of the present invention may be attached to another medium via an adhesive layer. Alternatively, a back coat layer may be provided on one side (back surface) of a support such as PET film; on the opposite side of the back coat layer, a release layer that is used in a thermal transfer ribbon may be provided; a reversible thermosensitive recording layer may be provided on the release layer; on a surface, a resin layer capable of transfer onto a resin film or PET film may be further provided; and the transfer may be carried out with a thermal transfer printer. The reversible thermosensitive recording medium of the present invention may be processed into a sheet or card. The reversible thermosensitive recording medium can be processed so as to have an arbitrary shape. Moreover, a printing process may be performed on the top or back surface of the reversible thermosensitive recording medium. When being processed into a card, the reversible thermosensitive recording medium may serve as a magnetic card or IC card after being equipped with a magnetic layer or IC chip. Both sides of the reversible thermosensitive recording medium of the present invention may be reversible thermosensitive recording media; or alternatively, an irreversible thermosensitive recording layer may be used together. At this time, the coloring and color tone of each recording layer may be the same, or differ from each other.

<Principles of Reversible Coloring and Decoloring>

The following provides a brief description of the principles of reversible coloring and decoloring in the reversible thermosensitive recording medium. According to a typical reversible thermosensitive recording medium, on a surface of a support that is made of paper, or a plastic card and in the shape of a film, sheet, or plate, a reversible thermosensitive recording layer is formed with the use of a composition that is obtained by mixing and dispersing a color former and a developer in a binder such as thermoplastics resin. The composition that contains the color former and the developer contained in the reversible thermosensitive recording layer does not produce color when the color former and the developer are simply mixed in a solid state. However, as the composition rises in temperature, the composition as a whole falls into a molten state, causing the color former and the developer to react with each other and produce color. The cold removal of the composition in a molten state allows the color former and the developer to become dissociated at around a melting temperature thereof and then condense or crystallize individually before being decolored. Then, the above situation turns into a frozen state as the binder, such as thermoplastics resin, becomes solidified. However, when the composition that has produced color and is in a molten state is rapidly cooled, the thermoplastics resin could be solidified before the color former and the developer become dissociated, and the reaction products of the color former and the developer may fall in a frozen state and become solidified while producing color. If a composition that has a proper melting temperature and freezing temperature and is made of a combination of two types of compound that induce such a phenomenon and a binder is selected, the coloring and the decoloring can be selected by adjusting the cooling rate after heating and melting take place. At normal temperatures, the colored and decolored states each can be maintained in a frozen state.

Figure 4:
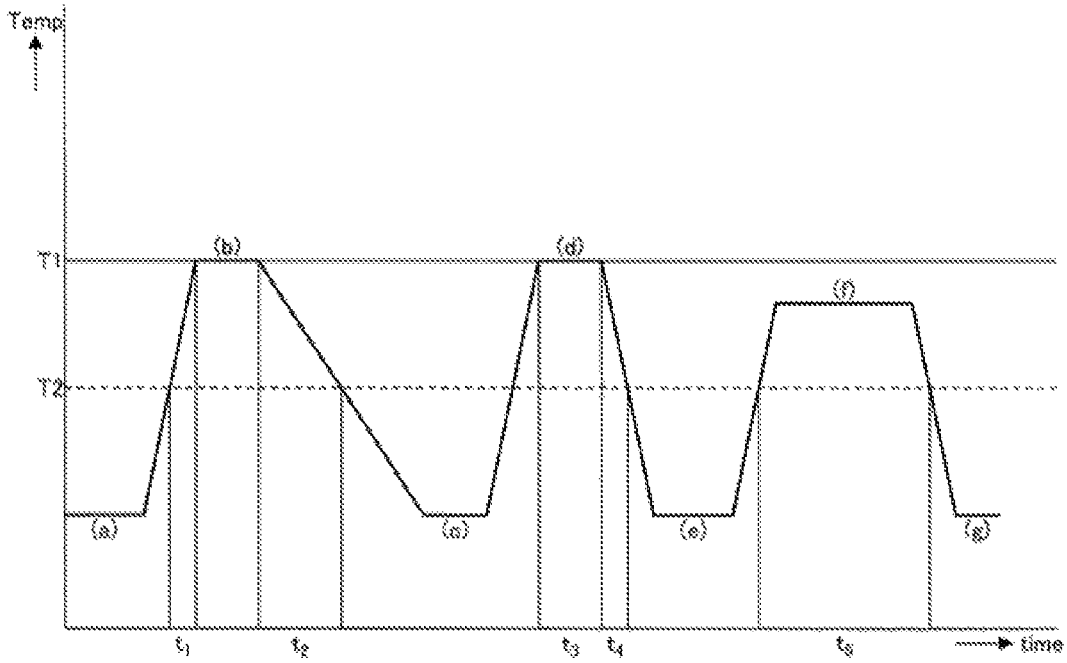
FIG. 4 is a schematic diagram showing the principles of coloring and decoloring of a reversible thermosensitive recording medium according to the present invention.

FIG. 4 is a graph showing changes over time of coloring and decoloring with respect to changes in temperature of the reversible thermosensitive recording medium. In FIG. 4, the horizontal axis represents time, and the vertical axis represents temperature. "T1" represents a melting and coloring reaction temperature of the color former and the developer. "T2" represents a temperature at which a composition made up of the color former and developer and the binder becomes solidified in a frozen state. That is, in a temperature range between T1 and T2, the reaction products of the color former and developer in the composition that has produced color become dissociated into the color former and the developer, and the color former and the developer each can become condensed or crystallized. However, it takes a certain amount of reaction time for the reaction products to be condensed or crystallized after becoming dissociated.

In the graph of FIG. 4, suppose that a composition, which is in a state (a) (defined as a colored state) at a normal temperature at the beginning, is heated to the temperature T1. The composition melts during a time period t1 after reaching the temperature T1, but keeps a colored state (b). The cold removal thereof takes place so that the temperature is brought to T2 over a time period t2. Then, the temperature is brought back to a normal temperature. The time period t2 is greater than or equal to a time period required for the reaction products, which have melted and produced color, to become dissociated into the color former and the developer and then condensed or crystallized. Therefore, before the composition is solidified and falls into a frozen state, the reaction products become dissociated, meaning that the reaction products are frozen in a decolored state (c) at a normal temperature.

When the decolored composition falls into a molten state (d) after being heated again, the color former and developer in the composition melt, react and produce color. The composition is then cooled rapidly during a short time period t4, and is left at a normal temperature. As a result, the temperature of the composition is brought to a normal temperature in a state (e) where a reacted molecular state is kept frozen while the composition keeps producing color.

Furthermore, when the composition in the state (e) is exposed for a long time period t5 to a dissociation and crystallization temperature region that exists between melting temperatures T1 and T2 (state (f)), the reaction products could be dissociated into the color former and developer, each of which then could become condensed or crystallized before being decolored. Even in this case, the composition remains in a decolored state (g) after being brought back to a normal temperature. When the phase change of such a composition is used, the composition can be colored or decolored by controlling the temperatures of heating and cooling and the cooling rate. Incidentally, in the graph, the distance between T1 and T2 has been schematically made larger. However, the composition is actually so selected that the temperature interval is a several degrees Celsius to about 10° C.

<Forming and Erasing Image for Reversible Thermosensitive Recording Medium>

As for a method of forming an image onto the reversible thermosensitive recording medium of the present invention and erasing the image, the following methods are available depending on the intended use: image formation methods, which use coloring and decoloring methods for a conventional reversible thermosensitive recording medium, such as a heat stylus, a thermal head or laser heating.

Figure 5:
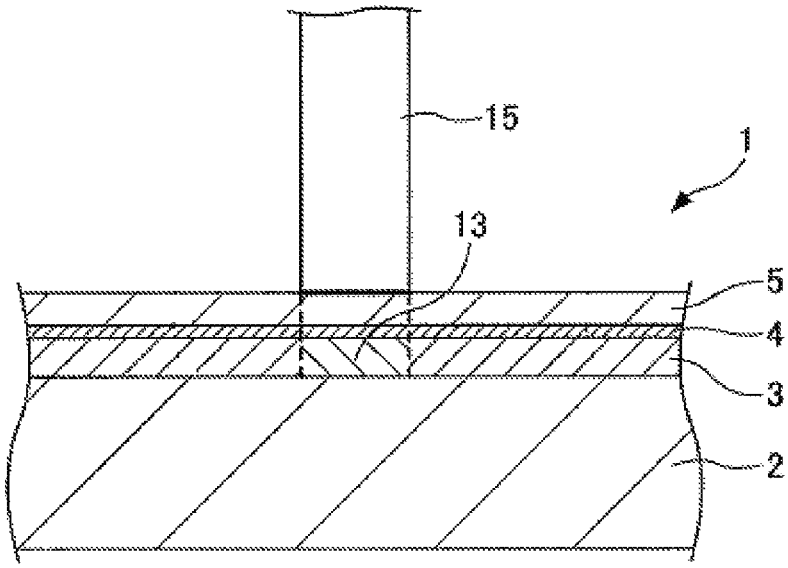
FIG. 5 is a schematic diagram showing a coloring method of a reversible thermosensitive recording medium according to the present invention.
Figure 6:
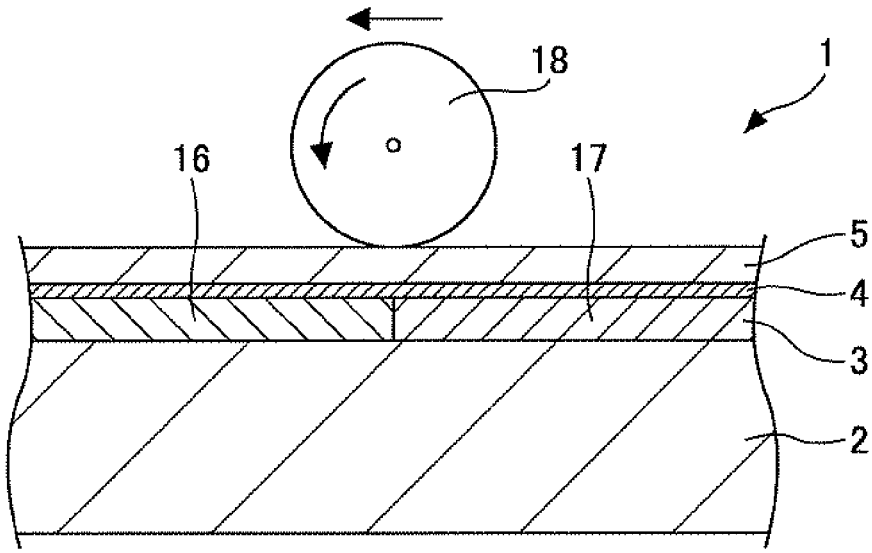
FIG. 6 is a schematic diagram showing a decoloring method of a reversible thermosensitive recording medium according to the present invention.

FIG. 5 is a diagram showing a coloring method of the reversible thermosensitive recording medium according to the present invention. FIG. 6 is a diagram showing a decoloring method of the reversible thermosensitive recording medium according to the present invention.

With reference to FIG. 5, the coloring method of the reversible thermosensitive recording medium of the present invention will be described.

First, a small-area heating head 15, such as a thermal head of a dot printer, is pushed onto the surface of the reversible thermosensitive recording medium 1 that has not yet been colored. Since the reversible thermosensitive recording layer 3, the barrier layer 4 and the protective layer 5 are thin, a to-be-heated portion 13 of the reversible thermosensitive recording layer 3 is immediately heated, and reaches a melting point of the color former, which make up the thermosensitive recording layer 3. Then, the color former and the developer in the to-be-heated portion 13 of the reversible thermosensitive recording layer 3 that faces the heating head 15 melt, react and produce color. If the heating head 15 is removed from the surface of the reversible thermosensitive recording medium 1, the to-be-heated portion 13 of the reversible thermosensitive recording medium 1 is immediately cooled because the to-be-heated portion 13 is small in size. As a result, the to-be-heated portion 13 falls into a frozen state while producing color.

With reference to FIG. 6, the decoloring method of the reversible thermosensitive recording medium of the present invention will be described.

First, the surface of the reversible thermosensitive recording medium 1 is heated so that a to-be-heated area of the reversible thermosensitive recording layer 3 melts. In this case, rather than a small area such as the above thermal head, a relatively large area is preferably heated with a heating roller 18 as shown in FIG. 6, for example. After the to-be-heated area of the reversible thermosensitive recording layer 3 has melted, the to-be-heated area moves as the heating roller 18 rolls. In this manner, the to-be-heated area, which has once melted and produced color, is cooled relatively slowly. Meanwhile, the color former and the developer in the reversible thermosensitive recording layer 3 are dissociated and each become condensed or crystallized. As a result, the reversible thermosensitive recording layer 3 is decolored, and then falls into a frozen state after being cooled down to a normal temperature. According to the above decoloring method, even a portion not producing color is heated. However, usually as for decoloring, all that is required is for the entire reversible thermosensitive recording medium to be decolored. Therefore, the above method is useful. In the case of FIG. 6, if the heating roller 18 rolles to the left side along a direction indicated by arrow in the diagram, an unheated portion 16 of the thermosensitive recording layer 3, which has so far produced color, is turned into a decolored area 17 as the heating roller 18 moves to bring about the heating and cold removal of the unheated portion 16.

(Reversible Thermosensitive Recording Member)

A reversible thermosensitive recording member of the present invention includes an information storage section and a reversible display section. The reversible display section includes the reversible thermosensitive recording medium of the present invention, and also includes other members if necessary.

The reversible thermosensitive recording layer, which is capable of displaying in a reversible manner, and the information storage section are provided in the same card (or formed integrally); some of information stored in the information storage section is displayed on the thermosensitive recording layer. Therefore, a card holder or any other person can confirm information by only seeing the card without using a special device. Thus, the card is excellent in convenience. Moreover, what is displayed on a reversible thermosensitive recording section is rewritten when the contents of the information storage section is rewritten. Therefore, the reversible thermosensitive recording medium can be used repeatedly.

Members having the information storage section and the reversible display section are roughly divided into the following two:

(1) One that directly forms a reversible thermosensitive recording layer, with a portion of a member having an information storage section as a support of a reversible thermosensitive recording medium; and (2) One that bonds a support plane of a reversible thermosensitive recording medium, which is formed separately and has a reversible thermosensitive recording layer on a support, to a member having an information storage section.

In the above cases (1) and (2), settings are so made that each of the functions of the information storage section and the reversible display section can be fulfilled. Accordingly, a set-up location of the information storage section may be provided on a surface opposite to a surface on which the reversible thermosensitive recording layer of the support in the reversible thermosensitive recording medium is provided; or may be provided between the support and the reversible thermosensitive recording layer; or may be provided on a portion of the thermosensitive recording layer.

The information storage section is not specifically restricted. However, for example, the following are preferably used: a magnetic thermosensitive recording layer, a magnetic stripe, an IC memory, an optical memory, an RF-ID tag, and a hologram. In particular, for a sheet medium of a size larger than a card size, an IC memory and an RF-ID tag are preferably used. Incidentally, the RF-ID tag includes an IC chip and an antenna, which is connected to the IC chip.

The magnetic thermosensitive recording layer may be applied and formed on the support with the use of, for example, iron oxide, barium ferrite, vinyl chloride resin, urethane resin, or nylon resin. Alternatively, the magnetic thermosensitive recording layer may be formed by vapor deposition, sputtering or any other method without using resins. The magnetic thermosensitive recording layer may be provided on a surface opposite to the thermosensitive recording layer on the support; or may be provided between the support and the thermosensitive recording layer; or may be provided on a portion of the thermosensitive recording layer. Moreover, a reversible thermosensitive recording material used for displaying may be used for a storage section with the use of a bar code, or a two-dimensional code.

As for the hologram, a rewritable one is preferred. For example, the following can be listed: a rewritable hologram in which the interfering light is written to a polymer azobenzene liquid crystal film.

As for members having the information storage sections, in general, the following can be listed: a card, a disk, a disk cartridge, or a tape cassette. Specifically, the following can be listed: an IC card, a thick card such as an optical card, a flexible disk, a magneto-optic recording disk (MD), a disk cartridge having a built-in disk where information stored can be rewritten such as DVD-RAM, a disc using no disc cartridge such as CD-RW, a write-once-read-many optical disk such as CD-R, an optical information recording medium using a phase-change recording material (CD-RW), and a video tape cassette.

As for a member having both the reversible display section and the information storage section, for example, when the use of a card is described, some of the information stored in the information storage section is displayed on the thermosensitive recording layer. Therefore, a card holder or any other person can confirm information by only seeing the card without using a special device. Thus, there is a significant improvement in convenience compared with a card to which no reversible thermosensitive recording medium is applied. The information storage section is not specifically restricted as long as the information storage section can store necessary information, and can be selected appropriately according to the purpose. For example, the following are useful: magnetic recording, a contact-type IC, a noncontact-type IC, or an optical memory.

Specifically, in particular, the members are suitably used for the following reversible thermosensitive recording labels, reversible thermosensitive recording members, image processing devices and image processing methods of the present invention. Incidentally, according to the present invention, the surface of the reversible thermosensitive recording medium means a thermosensitive recording layer-side surface; is not limited to the protective layer; and means an entire plane that comes in contact with a thermal head at the time of printing or erasing, or part of the plane, such as a printing-layer surface or overhead-layer surface.

EXAMPLES

The following describes examples of the present invention. However, the present invention is not limited to the examples.

Example 1

Creating Reversible Thermosensitive Recording Medium

—Support—

For the support, an opaque polyester film having a thickness of 125 μm (TETRON FILM U2L98W, manufactured by Teijin Dupont Ltd.) was used.

—Forming Under Layer—

The following were added and stirred for about one hour until being spread evenly in order to prepare an under-layer application liquid: 30 parts by mass of a styrene-butadiene copolymer (PA-9159, manufactured by NIPPON A & L INC.), 12 parts by mass of a polyvinyl alcohol resin (Poval PVA103, manufactured by Kuraray Co., Ltd.), 20 parts by mass of hollow particles (Microsphere R300 with a hollow rate of 90%, manufactured by Matsumoto Yushi-Seiyaku Co., Ltd), and 40 parts by mass of water. The obtained under-layer application liquid was applied to the surface of the support with the use of a wire bar, and was heated and dried for two minutes at 80° C. to form an under layer having a thickness of 20 μm.

—Forming Reversible Thermosensitive Recording Layer—

The following were crushed by a ball mill to pieces until the mean particle diameter of the pieces comes to 1 μm in order to produce a dispersing liquid: 3 parts by mass of an electron-accepting compound (developer) represented by the following structural formula, 1 part by mass of dialkyl urea (Hakreen SB, manufactured by Nippon Kasei Chemical), 9 parts by mass of a methyl ethyl ketone solution with 50% by mass of acrylic polyol (LR327, manufactured by MITSUBISHI RAYON CO., LTD.), and 70 parts by mass of methyl ethyl ketone.

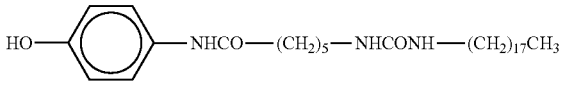

Then, to the dispersing liquid containing the crushed electron-accepting compound (developer), the following were added and stirred well to obtain a reversible thermosensitive recording layer application liquid: 1 part by mass of 2-anilino-3-methyl-6-di(n-butylamino)fluoran, which serves as an electron-donating color-forming compound (color former), and 3 parts by mass of isocyanate (CORONATE HL, manufactured by Nippon Polyurethane Industry Co., Ltd.). The obtained reversible thermosensitive recording layer application liquid was applied to the surface of the under layer with the use of a wire bar; was dried for two minutes at 100° C.; and was cured for 24 hours at 60° C. to form a reversible thermosensitive recording layer having a thickness of 11 μm.

—Forming Anchor Layer—

Into 125 parts by mass of ethyl acetate, the following were mixed in order to obtain an anchor layer application liquid: 15 parts by mass of a polyester polyol resin (TAKELAC A-3210, manufactured by Mitsui Chemicals Polyurethane Co., Ltd.), and 10 parts by mass of an isocyanate compound (TAKENATE A-3070, manufactured by Mitsui Chemicals Polyurethane Co., Ltd.). The obtained anchor layer application liquid was applied to the surface of the reversible thermosensitive recording layer with the use of a wire bar, and was dried for one minute at 80° C. to form an anchor layer having a thickness of 0.7 μm.

—Forming Metallic Compound-Containing Layer (Gas Barrier Layer)—

(1) Preparing Solution of Ethylene-Vinylalcohol Copolymer

To 60 parts by mass of a mixed solvent containing 50% by mass of purified water and 50% by mass of iso-propyl alcohol (IPA), 30 parts by mass of an ethylene-vinylalcohol copolymer (Soarnol D-2908, manufactured by The Nippon Synthetic Chemical Industry Co., Ltd.; also simply referred to as "EVOH," hereinafter) and then 10 parts by mass of hydrogen peroxide water with a concentration of 30% by mass were added and heated to 80° C. while being stirred, so that the reaction took place for about two hours. Then, the above was cooled, and catalase was added so as to be at 3,000 ppm. The remaining hydrogen peroxide was removed to obtain a substantially transparent ethylene-vinylalcohol copolymer solution whose solid content is 30% by mass.

(2) Preparing Inorganic Layered Compound Dispersing Liquid

Five parts by mass of natural montmorillonite (Kunipia F, manufactured by KUNIMINE INDUSTRIES CO., LTD.), which is an inorganic layered compound, were added into 95 parts by mass of purified water while being stirred, and were sufficiently dispersed by a high-speed stirring device. Then, the above was maintained at 40° C. for one day, and an inorganic layered compound dispersing liquid whose solid content is 5% by mass was obtained.

(3) Preparing Metallic Compound-Containing Layer (Gas Barrier Layer) Application Liquid, and Forming Metallic Compound-Containing Layer (Gas Barrier Layer)

To 60.7 parts by mass of a mixed solvent containing 50% by mass of purified water and 50% by mass of n-propyl alcohol (NPA), 15.7 parts by mass of the ethylene-vinylalcohol copolymer solution prepared in (1) was added, and was stirred and mixed well. While the solution was stirred at high speed, 23.6 parts of the inorganic layered compound dispersing liquid prepared in (2) was added. To 100 parts by mass of the mixed solution, 3 parts by mass of cation exchange resin particles were added and stirred for one hour at a speed that keeps the ion exchange resin particles from being crushed in order to remove cations. Then, the mixed solution was filtered by a strainer to separate only the cation exchange resin. To the obtained mixed solution, 0.06 parts by mass of magnesium hydroxide was added, and a dispersing process was carried out by a high-pressure dispersing device whose pressure was set to 50 MPa. After that, the mixed solution was filtered by a 300-mesh filter. As a result, a mixed solution (EVOH/inorganic layered compound=80 parts by mass/20 parts by mass) of the ethylene-vinylalcohol copolymer solution whose solid content is 5.9% by mass and the inorganic layered compound dispersing liquid was obtained. When 10 parts by mass of the obtained mixed solution was being stirred, 0.015 parts by mass of the 44-percent-by-mass titanium lactate solution (TC-310, manufactured by Matsumoto Fine Chemical Co., Ltd.), which is an organometallic compound, was added. As a result, a metallic compound-containing layer (gas barrier layer) application liquid was obtained. The obtained metallic compound-containing layer (gas barrier layer) application liquid was applied to the surface of the anchor layer with the use of a wire bar, and was dried for one minute at 80° C. in order to form a metallic compound-containing layer (gas barrier layer) having a thickness of 0.5 μm.

Incidentally, the amount of Ti contained in the formed metallic compound-containing layer (gas barrier layer) was 0.2% by mass.

Incidentally, the metallic compound-containing layer (gas barrier layer) was identified by a scanning electron microscope (SEM) (ULTRA55, manufactured by Carl Zeiss). The organometallic compound in the metallic compound-containing layer (gas barrier layer) was identified by an X-ray analysis device (EMAX ENERGY, manufactured by HORIBA, Ltd.).

—Forming Thermosetting Resin-Containing Layer (Primer Layer)—

In 50 parts by mass of a mixed liquid containing 30% by mass of methyl ethyl ketone, 20% by mass of isopropyl alcohol and 50% by mass of ethyl acetate, 50 parts by mass of a polyvinyl butyral resin (S-LEC BL-1, manufactured by Sekisui Chemical Co., Ltd.) was dissolved. Then, 3 parts by mass of an isocyanate compound (hardening agent Lamiall R, manufactured by Sakata Inx Corporation) was mixed. As a result, a thermosetting resin-containing layer (primer layer) application liquid was obtained. The obtained thermosetting resin-containing layer (primer layer) application liquid was applied to the surface of the metallic compound-containing layer (gas barrier layer) with the use of a wire bar, and was dried for one minute at 80° C. in order to form the thermosetting resin-containing layer (primer layer) having a thickness of 0.8 μm.

Incidentally, the thermosetting resin-containing layer (primer layer) was identified by a scanning electron microscope (SEM) (ULTRA55, manufactured by Carl Zeiss).

—Forming Protective Layer—

The following were added and stirred well by a ball mill, and were dispersed until the mean particle diameter came to 3 μm in order to prepare a protective layer application liquid: 9 parts by mass of a polyester acrylate resin (M9060, manufactured by TOAGOSEI CO., LTD.), 1 part by mass of silica particles (amorphous P-526, manufactured by MIZUSAWA INDUSTRIAL CHEMICALS, LTD.), 0.5 part by mass of a photoinitiator (IRGACURE184, manufactured by Nihon-Ciba Geigy K.K.), 0.001 part by mass of a lubricant (ST102PA, manufactured by Dow Corning Toray Co., Ltd.), and 11 parts by mass of isopropyl alcohol.

The obtained protective layer application liquid was applied onto the thermosetting resin-containing layer (primer layer) with the use of a wire bar, and was heated and dried for one minute at 90° C. After that, the above was irradiated with light with the use of an 80 W/cm ultraviolet lamp so that cross-linking takes place. Then, the above was cured for 24 hours at 70° C., and a protective layer having a thickness of 4 μm was formed as a result. As described above, the reversible thermosensitive recording medium of Example 1 was produced.

Example 2

Creating Reversible Thermosensitive Recording Medium

Except that the polyester acrylate resin (M9060, manufactured by TOAGOSEI CO., LTD.) in Example 1 was replaced with a polyester acrylate resin (M8060, manufactured by TOAGOSEI CO., LTD.) in the formation of the protective layer, a reversible thermosensitive recording medium of Example 2 was produced in the same way as in Example 1.

Example 3

Creating Reversible Thermosensitive Recording Medium

Except that the polyester acrylate resin (M9060, manufactured by TOAGOSEI CO., LTD.) in Example 1 was replaced with a polyester acrylate resin (M8030, manufactured by TOAGOSEI CO., LTD.) in the formation of the protective layer, a reversible thermosensitive recording medium of Example 3 was produced in the same way as in Example 1.

Example 4

Creating Reversible Thermosensitive Recording Medium

Except that the polyester acrylate resin (M9060, manufactured by TOAGOSEI CO., LTD.) in Example 1 was replaced with a mixture (1:1 (mass ratio)) of the polyester acrylate resin (M9060, manufactured by TOAGOSEI CO., LTD.) and a polyester acrylate resin (M7100, manufactured by TOAGOSEI CO., LTD.) in the formation of the protective layer, a reversible thermosensitive recording medium of Example 4 was produced in the same way as in Example 1.

Example 5

Creating Reversible Thermosensitive Recording Medium

Except that the polyester acrylate resin (M9060, manufactured by TOAGOSEI CO., LTD.) in Example 1 was replaced with a mixture (1:1 (mass ratio)) of the polyester acrylate resin (M9060, manufactured by TOAGOSEI CO., LTD.) and a polyester acrylate resin (M7100, manufactured by TOAGOSEI CO., LTD.) in the formation of the protective layer and that hollow particles (Ropaque HP-91 with a hollow rate of 50%, manufactured by Rohm and Haas Japan K.K.) of the under layer were used, a reversible thermosensitive recording medium of Example 5 was produced in the same way as in Example 1.

Example 6

Creating Reversible Thermosensitive Recording Medium

Except that the under layer in Example 1 was not provided, a reversible thermosensitive recording medium of Example 6 was produced in the same way as in Example 1.

Example 7

Creating Reversible Thermosensitive Recording Medium

Except that the polyester acrylate resin (M9060, manufactured by TOAGOSEI CO., LTD.) in Example 1 was replaced with a polyester acrylate resin (M8060, manufactured by TOAGOSEI CO., LTD.) in the formation of the protective layer and that the silica particles (amorphous P-526, manufactured by MIZUSAWA INDUSTRIAL CHEMICALS, LTD.) were replaced with silicone particles (spherical Tospearl 145, manufactured by Toshiba Silicone Co., Ltd.), a reversible thermosensitive recording medium of Example 7 was produced in the same way as in Example 1.

Example 8

Creating Reversible Thermosensitive Recording Medium

Except that the polyester acrylate resin (M9060, manufactured by TOAGOSEI CO., LTD.) in Example 1 was replaced with a polyester acrylate resin (M8030, manufactured by TOAGOSEI CO., LTD.) in the formation of the protective layer and that the silica particles (amorphous P-526, manufactured by MIZUSAWA INDUSTRIAL CHEMICALS, LTD.) were replaced with silicone particles (spherical Tospearl 120, manufactured by Toshiba Silicone Co., Ltd.), a reversible thermosensitive recording medium of Example 8 was produced in the same way as in Example 1.

Example 9

Creating Reversible Thermosensitive Recording Medium

Except that the polyester acrylate resin (M9060, manufactured by TOAGOSEI CO., LTD.) in Example 1 was replaced with a polyester acrylate resin (M8030, manufactured by TOAGOSEI CO., LTD.) in the formation of the protective layer and that the silica particles (amorphous P-526, manufactured by MIZUSAWA INDUSTRIAL CHEMICALS, LTD.) were replaced with a 1:1 (mass ratio) mixture of the silica particles (amorphous P-526, manufactured by MIZUSAWA INDUSTRIAL CHEMICALS, LTD.) and silicone particles (spherical Tospearl 120, manufactured by Toshiba Silicone Co., Ltd.), a reversible thermosensitive recording medium of Example 9 was produced in the same way as in Example 1.

Example 10

Creating Reversible Thermosensitive Recording Medium

Except that the polyester acrylate resin (M9060, manufactured by TOAGOSEI CO., LTD.) in Example 1 was replaced with a polyester acrylate resin (M8030, manufactured by TOAGOSEI CO., LTD.) in the formation of the protective layer and that the silica particles (amorphous P-526, manufactured by MIZUSAWA INDUSTRIAL CHEMICALS, LTD.) were replaced with silica particles (amorphous E220A, manufactured by Nihon Silica Kogyo K.K.), a reversible thermosensitive recording medium of Example 10 was produced in the same way as in Example 1.

Comparative Example 1

Creating Reversible Thermosensitive Recording Medium

Except that the protective layer in Example 1 was formed in the following manner, a reversible thermosensitive recording medium of Comparative Example 1 was produced in the same way as in Example 1.

—Forming Protective Layer—

The following were added and stirred well by a ball mill, and were dispersed until the mean particle diameter came to 3 μm in order to prepare a protective layer application liquid: 9 parts by mass of dipentaerythritol hexaacrylate (KAYARAD DPHA, manufactured by Nippon Kayaku Co., Ltd.), 1 part by mass of silica particles (amorphous P-526, manufactured by MIZUSAWA INDUSTRIAL CHEMICALS, LTD.), 0.5 part by mass of a photoinitiator (IRGACURE184, manufactured by Nihon-Ciba Geigy K.K.), 0.001 part by mass of a lubricant (ST102PA, manufactured by Dow Corning Toray Co., Ltd.), and 11 parts by mass of isopropyl alcohol. The obtained protective layer application liquid was applied onto the thermosetting resin-containing layer (primer layer) with the use of a wire bar, and was heated and dried for one minute at 90° C. After that, the above was irradiated with light with the use of an 80 W/cm ultraviolet lamp so that cross-linking took place. Then, the above was cured for 24 hours at 70° C., and a protective layer having a thickness of 4 nm was formed as a result.

Comparative Example 2

Creating Reversible Thermosensitive Recording Medium

Except that the dipentaerythritol hexaacrylate (KAYARAD DPHA, manufactured by Nippon Kayaku Co., Ltd.) in Comparative Example 1 was replaced with ethylene oxide-modified dipentaerythritol hexaacrylate (KAYARAD DPEA-12, manufactured by Nippon Kayaku Co., Ltd.), a reversible thermosensitive recording medium of Comparative Example 2 was produced in the same way as in Comparative Example 1.

Comparative Example 3

Creating Reversible Thermosensitive Recording Medium

Except that the dipentaerythritol hexaacrylate (KAYARAD DPHA, manufactured by Nippon Kayaku Co., Ltd.) in Comparative Example 1 was replaced with a polyester acrylate resin (A-9300-1CL, manufactured by Shin Nakamura Chemical Co., Ltd.), a reversible thermosensitive recording medium of Comparative Example 3 was produced in the same way as in Comparative Example 1.

Comparative Example 4

Creating Reversible Thermosensitive Recording Medium

Except that the dipentaerythritol hexaacrylate (KAYARAD DPHA, manufactured by Nippon Kayaku Co., Ltd.) in Comparative Example 1 was replaced with a polyurethane resin (U-6LPA, manufactured by Shin Nakamura Chemical Co., Ltd.), a reversible thermosensitive recording medium of Comparative Example 4 was produced in the same way as in Comparative Example 1.

Comparative Example 5

Creating Reversible Thermosensitive Recording Medium

Except that the dipentaerythritol hexaacrylate (KAYARAD DPHA, manufactured by Nippon Kayaku Co., Ltd.) in Comparative Example 1 was replaced with a 1:1 (mass ratio) mixture of the dipentaerythritol hexaacrylate (KAYARAD DPHA, manufactured by Nippon Kayaku Co., Ltd.) and ethylene oxide-modified dipentaerythritol hexaacrylate (KAYARAD DPEA-12, manufactured by Nippon Kayaku Co., Ltd.), a reversible thermosensitive recording medium of Comparative Example 5 was produced in the same way as in Comparative Example 1.

Comparative Example 6

Creating Reversible Thermosensitive Recording Medium

Except that the dipentaerythritol hexaacrylate (KAYARAD DPHA, manufactured by Nippon Kayaku Co., Ltd.) in Comparative Example 1 was replaced with a 1:9 (mass ratio) mixture of the dipentaerythritol hexaacrylate (KAYARAD DPHA, manufactured by Nippon Kayaku Co., Ltd.) and ethylene oxide-modified dipentaerythritol hexaacrylate (KAYARAD DPEA-12, manufactured by Nippon Kayaku Co., Ltd.), a reversible thermosensitive recording medium of Comparative Example 6 was produced in the same way as in Comparative Example 1.

Comparative Example 7

Creating Reversible Thermosensitive Recording Medium

Except that the dipentaerythritol hexaacrylate (KAYARAD DPHA, manufactured by Nippon Kayaku Co., Ltd.)

in Comparative Example 1 was replaced with a 1:9 (mass ratio) mixture of the dipentaerythritol hexaacrylate (KAYARAD DPHA, manufactured by Nippon Kayaku Co., Ltd.) and ethylene oxide-modified dipentaerythritol hexaacrylate (KAYARAD DPEA-12, manufactured by Nippon Kayaku Co., Ltd.) and that no under layer is provided, a reversible thermosensitive recording medium of Comparative Example 7 was produced in the same way as in Comparative Example 1.

As for the produced protective layers and reversible thermosensitive recording media of Examples 1 to 10 and Comparative Examples 1 to 7, various characteristics were evaluated in the following manner. The results are shown in Table 1.

<Measuring Glass Transition Temperature Tg>

Using a sample (length: 50 mm, width: 10 mm) in which each of the protective layer application liquids prepared in Examples 1 to 10 and Comparative Examples 1 to 7 had been applied on a polyethylene terephthalate (PET) film with a thickness of 125 μm to form a protective layer with a thickness of 4 μm, the glass transition temperature Tg was measured by a rigid body pendulum tester (RPT-3000, manufactured by A & D Company, Limited).

<Measuring Elongation>

Using a sample (length: 100 mm, width: 10 mm) in which each of the protective layer application liquids prepared in Examples 1 to 10 and Comparative Examples 1 to 7 had been applied on a polyethylene terephthalate (PET) film with a thickness of 125 μm to form a protective layer with a thickness of 4 μm, the elongation was calculated by a tensile strength tester (MX2-500N, manufactured by IMADA Co., Ltd.) from the following equation. Incidentally, the presence or absence of cracks was confirmed by visually observing the surface of the sample.

$$\text{Elongation}(\%)=[(\text{length at the time of crack}-\text{original length})/\text{original length}]\times 100$$

<Frictional Resistance Value>

Using a sample (length: 100 mm, width: 10 mm) in which each of the protective layer application liquids prepared in Examples 1 to 10 and Comparative Examples 1 to 7 had been applied on a polyethylene terephthalate (PET) film with a thickness of 125 μm to form a protective layer with a thickness of 4 μm, the frictional resistance value was assessed by a friction and wear analysis device (TS501, manufactured by Kyowa Interface Science Co., Ltd.).

<Durability (Color Optical Density) Test>

On each of the reversible thermosensitive recording media, printing and erasing were repeated 300 times by a card printer (R-28000, manufactured by Panasonic Communications Co., Ltd.). The conditions for printing and erasing were as follows: the printing energy 0.57 mJ/dot; the erasing temperature 130° C.; and the transfer speed 56 mm/sec. After printing and erasing were repeated 300 times, the image density was measured by a density meter (X-rite 938).

<Evaluating Crack Resistance>

On each of the reversible thermosensitive recording media, printing and erasing were repeated 300 times by a card printer (R-28000, manufactured by Panasonic Communications Co., Ltd.). After that, the surfaces of the reversible thermosensitive recording media were visually assessed, and were evaluated based on the following evaluation criteria.

[Evaluation Criteria]

5: No crack on the surface of the medium

4: Occurrence of a very small amount of cracks

3: Partial occurrence of cracks

2: Occurrence of cracks in the most part

1: Occurrence of cracks over the entire surface, destroying the surface

<Evaluating Resistance to Formation of Head Residue>

On each of the reversible thermosensitive recording media, printing and erasing were repeated 300 times by a card printer (R-28000, manufactured by Panasonic Communications Co., Ltd.). After that, a head of the printer was observed under a microscope, and was evaluated for adhesion of residue based on the following evaluation criteria. In addition, the surfaces of the reversible thermosensitive recording media were visually assessed, and were evaluated for printing failure due to head residue based on the following evaluation criteria. Note that the printing failure means a state where letters and shapes printed on the reversible thermosensitive recording media are not recognizable since printing cannot be performed due to residue attached to the head of the printer.

[Evaluation Criteria]

5: No head residue, no printing failure

4: Occurrence of a very small amount of head residues, but no printing failure

3: Partial occurrence of head residues, and printing failure occurred partially

2: Occurrence of head residues in the most part, and printing failure occurred mostly 1: Occurrence of head residues over the entire surface, and printing failure occurred entirely

TABLE 1-1

| | Protective layer | | | | | |
|---|---|---|---|---|---|---|
| | UV resin | Particles | Tg(° C.) | Elongation (%) | Frictional resistance value | Under layer |
| Ex. 1 | M9060 | P526 | 250 | 10 | 1.13 | Exist (hollow rate 90%) |
| Ex. 2 | M8060 | P526 | 250 | 20 | 1.21 | Exist (hollow rate 90%) |
| Ex. 3 | M8030 | P526 | 250 | 15 | 1.18 | Exist (hollow rate 90%) |
| Ex. 4 | M9060 + M7100 = (1/1) | P526 | 230 | 20 | 1.23 | Exist (hollow rate 90%) |
| Ex. 5 | M9060 + M7100 = (1/1) | P526 | 230 | 20 | 1.23 | Exist (hollow rate 50%) |

TABLE 1-1-continued

| | Protective layer | | | | | |
|---|---|---|---|---|---|---|
| | UV resin | Particles | Tg(° C.) | Elongation (%) | Frictional resistance value | Under layer |
| Ex. 6 | M9060 | P526 | 250 | 10 | 1.13 | Not exist |
| Ex. 7 | M8060 | Tospearl 145 | 250 | 20 | 0.75 | Exist (hollow rate 90%) |
| Ex. 8 | M8030 | Tospearl 120 | 250 | 15 | 0.85 | Exist (hollow rate 90%) |
| Ex. 9 | M8030 | P526 + Tospearl 120 | 250 | 15 | 0.99 | Exist (hollow rate 90%) |
| Ex. 10 | M8030 | E220A | 250 | 15 | 1.23 | Exist (hollow rate 90%) |
| Comp. Ex. 1 | DPHA | P526 | 250 | 5 | 1.22 | Exist (hollow rate 90%) |
| Comp. Ex. 2 | DPEA-12 | P526 | 217 | 15 | 1.45 | Exist (hollow rate 90%) |
| Comp. Ex. 3 | A-9300-1CL | P526 | 172 | 20 | 1.55 | Exist (hollow rate 90%) |
| Comp. Ex. 4 | U-6LPA | P526 | 250 | 5 | 1.35 | Exist (hollow rate 90%) |
| Comp. Ex. 5 | DPHA + DPEA12 = (1/1) | P526 | 225 | 5 | 1.32 | Exist (hollow rate 90%) |
| Comp. Ex. 6 | DPHA + DPEA12 = (1/9) | P526 | 220 | 10 | 1.39 | Exist (hollow rate 90%) |
| Comp. Ex. 7 | DPHA + DPEA12 = (1/9) | P526 | 220 | 10 | 1.39 | Not Exist |

* M9060: polyester acrylate resin, manufactured by TOAGOSEI CO., LTD.
* M8060: polyester acrylate resin, manufactured by TOAGOSEI CO., LTD.
* M8030: polyester acrylate resin, manufactured by TOAGOSEI CO., LTD.
* M7100: polyester acrylate resin, manufactured by TOAGOSEI CO., LTD.
* DPHA: trade name; KAYARAD DPHA, dipenthaerythiritol acrylate, manufactured by Nippon Kayaku Co., Ltd.
* DPEA-12: trade name: KAYARAD DPEA-12, ethylene oxide-modified dipentaerythritol hexaacrylate, manufactured by Nippon Kayaku Co., Ltd.
* A-9300-1CL: polyester acrylate resin, manufactured by Shin Nakamura Chemical Co., Ltd.
* U-6LPA: polyurethane resin, manufactured by Shin Nakamura Chemical Co., Ltd.
* Silica particles: amorphous P526, manufactured by MIZUSAWA INDUSTRIAL CHEMICALS, LTD.
* Silicone particles: spherical Tospearl 145, manufactured by Toshiba Silicone Co., Ltd.
* Silicone particles: spherical Tospearl 120, manufactured by Toshiba Silicone Co., Ltd.
* Silica particles: amorphous E220A, manufactured by Nihon Silica Kogyo K.K.

TABLE 1-2

| | Durability (color optical density) | Crack resistance | Resistance to formation of residue on head |
|---|---|---|---|
| Example 1 | 1.38 | 4 | 4 |
| Example 2 | 1.36 | 5 | 4 |
| Example 3 | 1.36 | 5 | 4 |
| Example 4 | 1.40 | 5 | 4 |
| Example 5 | 1.25 | 5 | 4 |
| Example 6 | 1.20 | 5 | 4 |
| Example 7 | 1.45 | 5 | 5 |
| Example 8 | 1.45 | 5 | 5 |
| Example 9 | 1.40 | 5 | 5 |
| Example 10 | 1.31 | 5 | 4 |
| Comparative Example 1 | 1.10 | 1 | 4 |
| Comparative Example 2 | 0.90 | 5 | 1 |
| Comparative Example 3 | 0.82 | 5 | 1 |
| Comparative Example 4 | 0.92 | 1 | 4 |

TABLE 1-2-continued

| | Durability (color optical density) | Crack resistance | Resistance to formation of residue on head |
|---|---|---|---|
| Comparative Example 5 | 1.01 | 2 | 3 |
| Comparative Example 6 | 1.05 | 4 | 2 |
| Comparative Example 7 | 1.08 | 5 | 2 |

The embodiments of the present invention are as follows.

<1> A reversible thermosensitive recording medium comprising:

a support;

a reversible thermosensitive recording layer on the support; and a protective layer on the reversible thermosensitive recording layer, wherein the reversible thermosensitive recording layer contains an electron-donating color-forming compound and an electron-accepting compound, wherein the protective layer contains a polyester acrylate resin, and wherein the protective layer has a glass transition temperature of 230° C. or higher and has an elongation of 10% or higher.

<2> The reversible thermosensitive recording medium according to <1>, wherein the glass transition temperature of the protective layer is 250° C. or higher and the elongation of the protective layer is 15% or higher.

<3> The reversible thermosensitive recording medium according to <1> or <2>, wherein the protective layer has a frictional resistance value of 1.3 or less.

<4> The reversible thermosensitive recording medium according to any one of <1> to <3>, wherein the protective layer contains spherical particles, and the spherical particles are spherical silicone particles.

<5> The reversible thermosensitive recording medium according to any one of <1> to <4>, further including an under layer containing at least hollow particles, wherein the under layer is provided between the reversible thermosensitive recording layer and the support.

<6> The reversible thermosensitive recording medium according to <5>, wherein the hollow particles have a hollow rate of 70% or more, wherein the hollow particles have a maximum particle diameter D100 of 5 μm to 10 μm, and wherein the hollow particles have a ratio D100/D50 of 2 to 3 where D50 denotes a 50%-frequency particle diameter of the hollow particles.

<7> The reversible thermosensitive recording medium according to any one of <1> to <6>, further including a metallic compound-containing layer between the reversible thermosensitive recording layer and the protective layer, wherein the metallic compound-containing layer contains: a resin containing at least one selected from the group consisting of a polyvinyl alcohol polymer and an ethylene-vinylalcohol copolymer; an organometallic compound containing at least one selected from the group consisting of an organotitanium compound and an organozirconium compound; and an inorganic layered compound.

<8> The reversible thermosensitive recording medium according to <7>, wherein the metallic compound-containing layer has an average thickness of 0.1 μm to 10 μm.

<9> The reversible thermosensitive recording medium according to <7> or <8>, further including a thermosetting resin-containing layer containing a hardened product of a thermosetting resin composition, wherein the thermosetting resin-containing layer is provided between the metallic compound-containing layer and the protective layer.

<10> A reversible thermosensitive recording member including:

an information storage section; and a reversible display section, wherein the reversible display section includes the reversible thermosensitive recording medium according to any one of <1> to <9>.

<11> The reversible thermosensitive recording member according to <10>, wherein the information storage section includes at least one selected from the group consisting of a magnetic thermosensitive recording layer, a magnetic stripe, an IC memory, an optical memory, a hologram, an RF-ID tag card, a disk, a disk cartridge and a tape cassette.

The reversible thermosensitive recording medium and reversible thermosensitive recording member of the present invention are suitably used as output paper of facsimile, word processors, and scientific measurement machines, and as magnetic cards, such as commutation tickets of transportation systems, various prepaid cards and point cards, IC cards and IC tags.

This application claims priority to Japanese application No. 2011-061429, filed on Mar. 18, 2011, and incorporated herein by reference.

What is claimed is:

1. A reversible thermosensitive recording medium comprising:

a support;

a reversible thermosensitive recording layer on the support; and a protective layer on the reversible thermosensitive recording layer, wherein the reversible thermosensitive recording layer contains an electron-donating color-forming compound and an electron-accepting compound, wherein the protective layer contains a polyester acrylate resin, and wherein the protective layer has a glass transition temperature of 230° C. or higher and has an elongation of 10% or higher.

2. The reversible thermosensitive recording medium according to claim 1, wherein the glass transition temperature of the protective layer is 250° C. or higher and the elongation of the protective layer is 15% or higher.

3. The reversible thermosensitive recording medium according to claim 1, wherein the protective layer has a frictional resistance value of 1.3 or less.

4. The reversible thermosensitive recording medium according to claim 1, wherein the protective layer contains spherical particles, and the spherical particles are spherical silicone particles.

5. The reversible thermosensitive recording medium according to claim 1, further comprising an under layer containing at least hollow particles, wherein the under layer is provided between the reversible thermosensitive recording layer and the support.

6. The reversible thermosensitive recording medium according to claim 5, wherein the hollow particles have a hollow rate of 70% or more, wherein the hollow particles have a maximum particle diameter D100 of 5 μm to 10 μm, and wherein the hollow particles have a ratio D100/D50 of 2 to 3 where D50 denotes a 50%-frequency particle diameter of the hollow particles.

7. The reversible thermosensitive recording medium according to claim 1, further comprising a metallic compound-containing layer between the reversible thermosensitive recording layer and the protective layer, wherein the metallic compound-containing layer contains: a resin containing at least one selected from the group consisting of a polyvinyl alcohol polymer and an ethylene-vinylalcohol copolymer; an organometallic compound containing at least one selected from the group consisting of an organotitanium compound and an organozirconium compound; and an inorganic layered compound.

8. The reversible thermosensitive recording medium according to claim 7, wherein the metallic compound-containing layer has an average thickness of 0.1 μm to 10 μm.

9. The reversible thermosensitive recording medium according to claim 7, further comprising a thermosetting resin-containing layer containing a hardened product of a thermosetting resin composition, wherein the thermosetting resin-containing layer is provided between the metallic compound-containing layer and the protective layer.

10. A reversible thermosensitive recording member comprising:

an information storage section; and a reversible display section, wherein the reversible display section comprises a reversible thermosensitive recording medium which comprises:

a support;

a reversible thermosensitive recording layer on the support; and a protective layer on the reversible thermosensitive recording layer, wherein the reversible thermosensitive recording layer contains an electron-donating color-forming compound and an electron-accepting compound, wherein the protective layer contains a polyester acrylate resin, and wherein the protective layer has a glass transition temperature of 230° C. or higher and has an elongation of 10% or higher.

11. The reversible thermosensitive recording member according to claim 10, wherein the information storage section contains at least one selected from the group consisting of a magnetic thermosensitive recording layer, a magnetic stripe, an IC memory, an optical memory, a hologram, an RF-ID tag card, a disk, a disk cartridge and a tape cassette.

* * * * *